US008118617B2

(12) United States Patent
Jol

(10) Patent No.: US 8,118,617 B2
(45) Date of Patent: Feb. 21, 2012

(54) JACK ASSEMBLIES WITH CYLINDRICAL CONTACTS

(75) Inventor: Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/571,240

(22) Filed: Sep. 30, 2009

(65) Prior Publication Data

US 2011/0076896 A1 Mar. 31, 2011

(51) Int. Cl.
*H01R 11/22* (2006.01)

(52) U.S. Cl. ..... 439/668; 439/851

(58) Field of Classification Search ..... 439/668, 439/669, 843, 851
See application file for complete search history.

(56) References Cited

U.S. PATENT DOCUMENTS 2,490,317 A * 12/1949 Ostrak ..... 439/843
3,678,451 A * 7/1972 Boliver ..... 439/843
3,966,292 A 6/1976 Schultz
4,039,238 A * 8/1977 Johnson et al. ..... 439/843
4,734,064 A 3/1988 Knapp et al.
4,973,272 A * 11/1990 Chase et al. ..... 439/851
6,494,746 B2 12/2002 D'Addario
7,204,720 B1 4/2007 Shiu

* cited by examiner

*Primary Examiner* — Khiem Nguyen

(74) *Attorney, Agent, or Firm* — Kramer Levin Naftalis & Frankel LLP

(57) ABSTRACT

Jack assemblies having cylindrical contacts are provided. For example, an enclosure may provide a cavity with a longitudinal axis for receiving an electrical plug. The jack assembly may also include at least one jack contact positioned in the cavity. The jack contact may include a first end region extending about at least a portion of the axis and a contact region extending from the first end region towards the axis. The first end region may extend completely about the axis or just about a portion of the axis. The contact region may deflect and contact a first conductive region of the plug in multiple contact areas when the plug is inserted into the cavity.

17 Claims, 14 Drawing Sheets

JACK ASSEMBLIES WITH CYLINDRICAL CONTACTS

FIELD OF THE INVENTION

This can relate to jack assemblies of electronic devices and, more particularly, to such jack assemblies having cylindrical contacts.

BACKGROUND OF THE DISCLOSURE

Many electronic devices (e.g., media players and cellular telephones) often include a jack for transmitting information to and/or receiving information from a corresponding plug of a component coupled to the device. For example, many electronic devices include an audio jack into which an audio plug from a set of headphones can be inserted for transferring signals between the electronic device and the headphones. Such jacks often include one or more conductive pads operative to contact a respective plug contact portion or region to provide an electrical path through which signals (e.g., audio signals, power signals, and data signals) can be transferred. The conductive pads of the jack typically can be formed from stamped sheet metal and can be shaped to ensure electrical contact and retention when a plug is inserted in the jack. For example, a commonly used shape for conductive pads of a jack includes, for example, cantilever beams extending into a cavity of the jack and operative to deflect away from a plug when the plug is inserted in the jack cavity.

These cantilever beams, however, can take up large amounts of space within the jack assembly. In particular, a cantilever beam can require a substantial minimum length for ensuring that the force generated by the beam deflection is sufficient to maintain the beam in contact with a plug contact portion. Moreover, one end of the beam must be physically fixed to the jack assembly defining the jack cavity, which may often require significant real estate of the assembly. Additionally, the cantilever beam may provide only one region of contact with a respective plug contact portion. If this single region of contact is no longer maintained by the beam, the connection between the jack and that portion of the plug may be lost.

SUMMARY OF THE DISCLOSURE

Jack assemblies having cylindrical contacts and methods for creating the same are provided.

According to some embodiments, an electrical connector is provided. The connector may include an enclosure defining a cavity with a longitudinal axis for receiving an electrical plug. The connector may also include at least a first jack contact positioned in the cavity. The first jack contact may include at least a first end region extending about at least a first portion of the axis, and a contact region extending from the first end region towards the axis. In some embodiments, the first end region of the jack contact may extend completely about the axis. The contact region may deflect and contact a first conductive region of the plug when the plug is inserted into the cavity. In some embodiments the contact region may include two or more contact bands. A first contact band may contact a first portion of a first conductive region of the plug when the plug is inserted into the cavity, and a second contact band may contact a second portion of the first conductive region of the plug when the plug is inserted into the cavity.

According to some other embodiments, method for manufacturing a jack assembly is provided. The method may include manufacturing an enclosure with a cavity for receiving an electrical plug, deforming a jack contact, inserting the deformed jack contact into the cavity, and expanding the jack contact within the enclosure cavity. In some embodiments, the jack contact may include a first end region extending about a first portion of an axis, and the jack contact may be deformed by coiling the jack contact about the axis. In other embodiments, the jack contact may include a hollow tube having a longitudinal axis, and the jack contact may be deformed by reducing a cross-sectional area of at least a portion of the tube perpendicular to the longitudinal axis. Alternatively, the jack contact may be deformed by twisting a first end of the tube in a first direction about the axis and twisting a second end of the tube in a second direction about the axis that is opposite the first direction.

According to other embodiments, a method of manufacturing a jack contact is provided. The method may include providing a sheet of material having a top edge, a bottom edge, a right edge, and a left edge. A contact region of the sheet positioned between the top edge and a first end region may be deflected. The method may also include rolling the left edge towards the right edge about a longitudinal axis. In some embodiments, a second end region may be positioned between the top edge and the contact region, and one or more slots may be formed through the contact region from the first end region to the second end region.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION OF THE DISCLOSURE

Jack assemblies having cylindrical contacts and methods for creating the same are provided and described with reference to FIGS. 1-6D.

Figure 1:
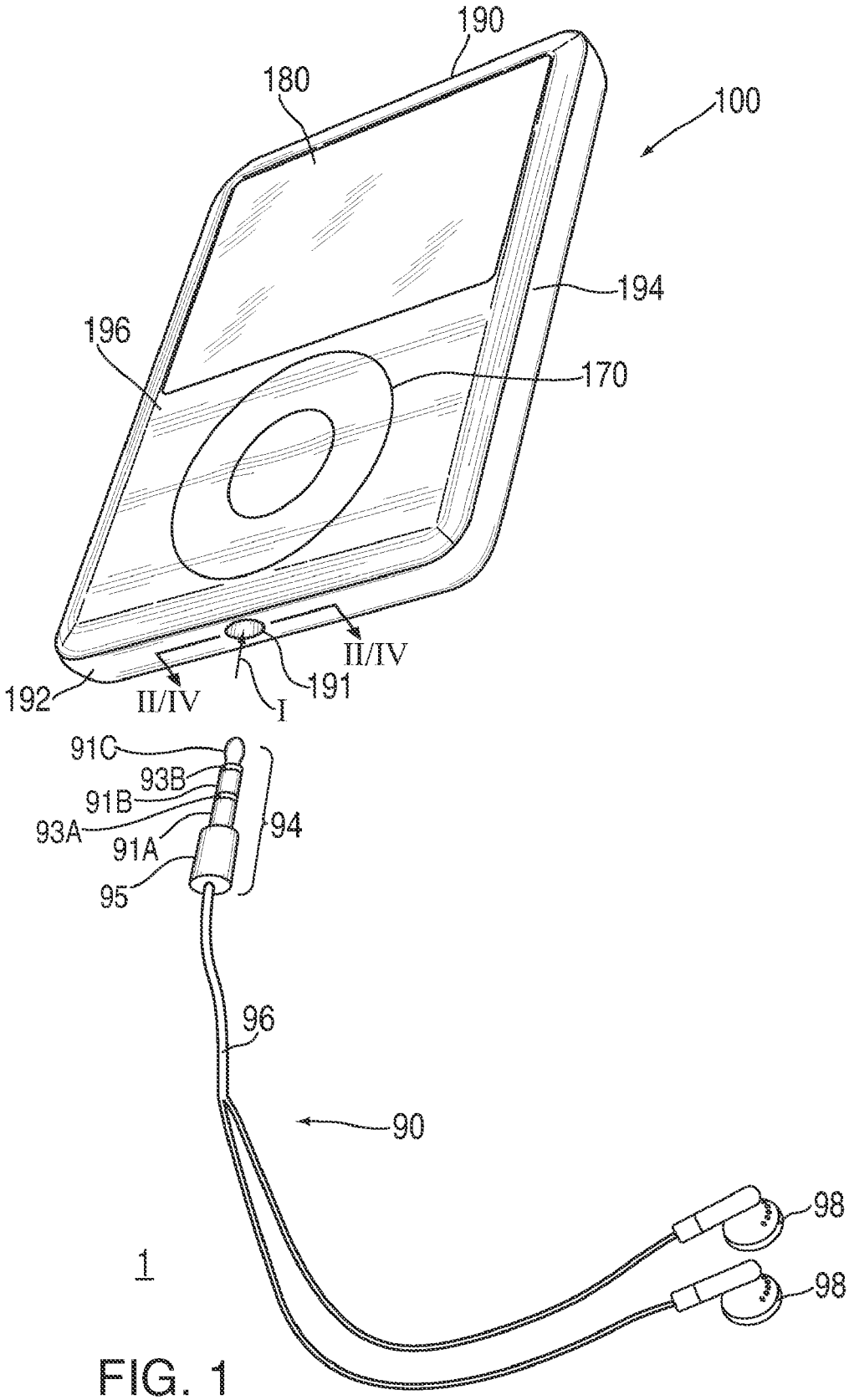
FIG. 1 is a bottom, front, right perspective view of a system including an accessory device having a plug assembly and an electronic device having a jack assembly in accordance with some embodiments of the invention.

FIG. 1 is a perspective view of an illustrative communication system 1 that may include an accessory device 90 having a connector plug assembly 94 and an electronic device 100 having a connector jack assembly 102 configured in accordance with various embodiments of the invention.

Electronic device 100 can include any suitable electronic device capable of communicating signals through jack 102 with another device (e.g., accessory device 90 through plug 94). The term "electronic device" can include, but is not limited to, music players, video players, still image players, game players, other media players, music recorders, video recorders, cameras, other media recorders, radios, medical equipment, domestic appliances, transportation vehicle instruments, musical instruments, calculators, cellular telephones, other wireless communication devices, personal digital assistants, remote controls, pagers, computers (e.g., desktops, laptops, tablets, servers, etc.), monitors, televisions, stereo equipment, set up boxes, set-top boxes, boom boxes, modems, routers, keyboards, mice, speakers, printers, and combinations thereof. In some embodiments, electronic device 100 may perform a single function (e.g., a device dedicated to playing music) and, in other embodiments, electronic device 100 may perform multiple functions (e.g., a device that plays music, displays video, stores pictures, and receives and transmits telephone calls).

Electronic device 100 may generally be any portable, mobile, hand-held, or miniature electronic device having a jack assembly. Miniature electronic devices may have a form factor that is smaller than that of hand-held personal media devices, such as an iPod™ Shuffle available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Alternatively, electronic device 100 may not be portable at all.

Along with at least one connector jack assembly 102, electronic device 100 may also include one or more electronic components configured to receive signals from jack 102 (e.g., signals communicated to jack 102 from plug 94) and/or to transmit signals to jack 102 (e.g., signals to be communicated by jack 102 to plug 94). For example, device 100 may include an input component (see, e.g., input component 170 of FIG. 1) that can allow a user to manipulate at least one function of the device, at least one output component (see, e.g., output component 180 of FIG. 1) that can provide the user with valuable device generated information, and at least one protective housing (see, e.g., housing 190 of FIG. 1) that can at least partially enclose jack 102, the one or more input components, and/or the one or more output components of the device.

Figure 2:
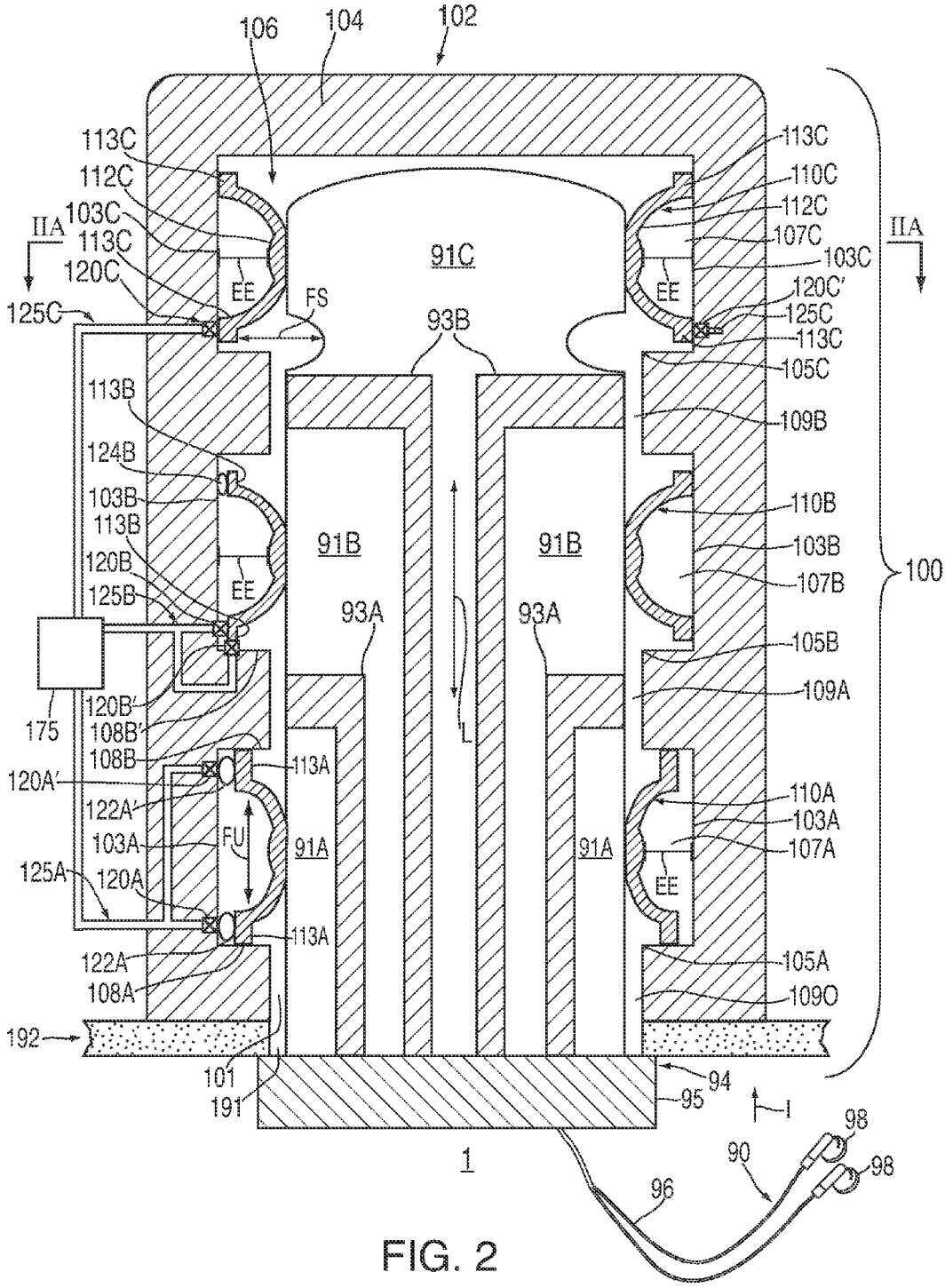
FIG. 2 is a horizontal cross-sectional view of the jack assembly of FIG. 1, taken from line II-II of FIG. 1, with the plug assembly of FIG. 1 inserted therein, in accordance with some embodiments of the invention.

As shown in FIG. 1, for example, housing 190 of device 100 can be hexahedral and may include a bottom wall 192, a top wall (not shown) opposite bottom wall 192, a right side wall 194, a left side wall (not shown) opposite right side wall 194, a front wall 196, and a back wall (not shown) opposite front wall 196. While each of the walls of housing 190 may be substantially flat (see, e.g., right side wall 194), the contour of one or more of the walls of housing 190 can be at least partially curved, jagged, or any other suitable shape or combination thereof, in order to contour at least a portion of the surface of device 100 to the hand of a user, for example. It should be noted that housing 190 of device 100 is only exemplary and need not be substantially hexahedral. For example, in certain embodiments, the intersects of certain walls may be beveled, and housing 190 itself may generally be formed in any other suitable shape, including, but not limited to, substantially spherical, ellipsoidal, conoidal, octahedral, or a combination thereof, for example. As shown in FIGS. 1 and 2, for example, connector jack assembly 102 may be provided at an opening 191 through bottom wall 192 of housing 190 of electronic device 100. However, it is to be understood that jack 102 of device 100 may be provided at any portion of any wall or walls of housing 190 and not just bottom wall 192.

Accessory device 90 can include any suitable device capable of communicating signals through a plug 94 with another device (e.g., electronic device 100 through jack 102). For example, accessory device 90 may also be any suitable electronic device, such as those described with respect to electronic device 100, or any other suitable type of device configured to communicate with electronic device 100. Along with at least one connector plug 94, accessory device 90 may also include one or more electronic components configured to receive signals from plug 94 (e.g., signals communicated to plug 94 from jack 102) and/or to transmit signals to plug 94 (e.g., signals to be communicated by plug 94 to jack 102). For example, as shown in FIG. 1, accessory device 90 may be a headset that can include one or more ear buds 98 that may be coupled to plug 94, either directly or through a wired path 96.

Jack 102 may be configured to receive plug 94 for communicating a variety of signals including, for example, analog and digital audio signals, analog and digital video signals, power signals, control signals, other data signals, and the like, through one or more signal channels. For example, jack 102 may be configured to receive plug 94 when plug 94 is inserted into jack 102 through housing opening 191 in the direction of arrow I. One or more jack contact regions of jack 102 may be configured to electrically couple with one or more distinct plug electrical contact regions 91 of plug 94 to communicate signals through one or more respective signal channels. For example, plug 94 can be a tip, ring, sleeve ("TRS") connector plug, which can combine a tip connector electrical contact region, a ring connector electrical contact region, and a sleeve connector electrical contact region. Thus, as shown in FIGS. 1 and 2, jack 102 may be configured to receive plug 94 that may be a TRS connector including tip connector contact region 91C, ring connector contact region 91B, and sleeve connector contact region 91A.

Plug electrical contact regions 91 of plug 94 may be electrically insulated from one another by one or more insulators 93 (see, e.g., insulator 93A between contact regions 91A and 91B, and insulator 93B between contact regions 91B and 91C). Plug 94 may also include a base region 95 for coupling each electrical contact region 91 to a respective wire of wired path 96. In other embodiments, jack 102 may be configured to receive a plug 94 having any other suitable number of electrical contact regions 91, including just one or two contact regions, or four or more contact regions, such as a tip, ring, ring, sleeve ("TRRS") connector plug.

Jack 102 may be configured to receive plug 94 having any suitable form factor, including, but not limited to, a 3.5 millimeter (e.g., ⅛ inch) miniature plug, a 2.5 millimeter (e.g., 3⁄32 inch) subminiature plug, and a 6.3 millimeter (e.g., ¼ inch) plug. Moreover, jack 102 may be configured to receive any suitable type of plug 94 besides a TRS connector plug, such as a banana plug, an RCA plug, and the like.

Figure 4:
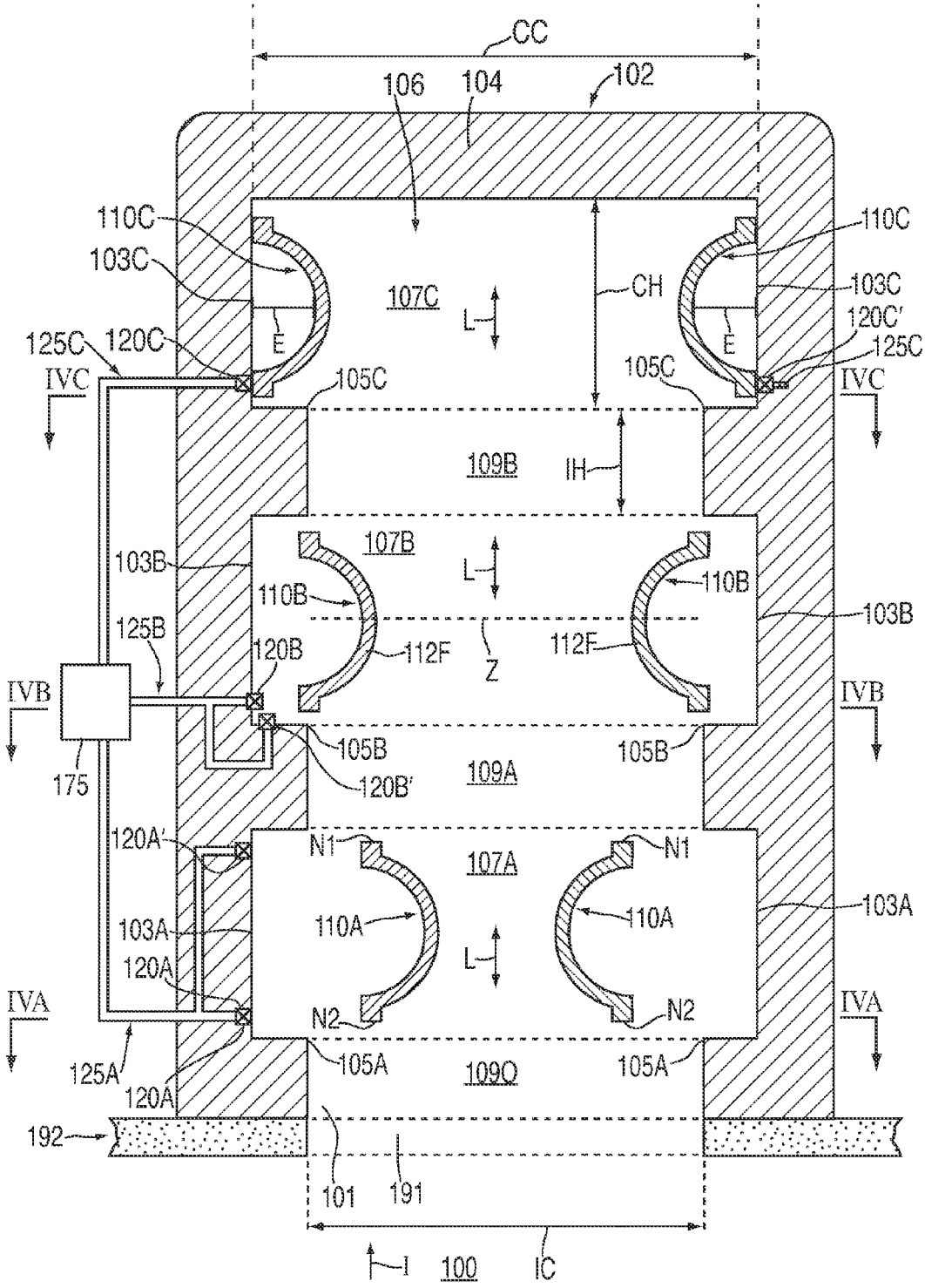
FIG. 4 is a horizontal cross-sectional view of the jack assembly of FIGS. 1-2A, taken from line IV-IV of FIG. 1, similar to FIG. 2, but with jack contacts in various stages of insertion, in accordance with some embodiments of the invention.
Figure 4A:
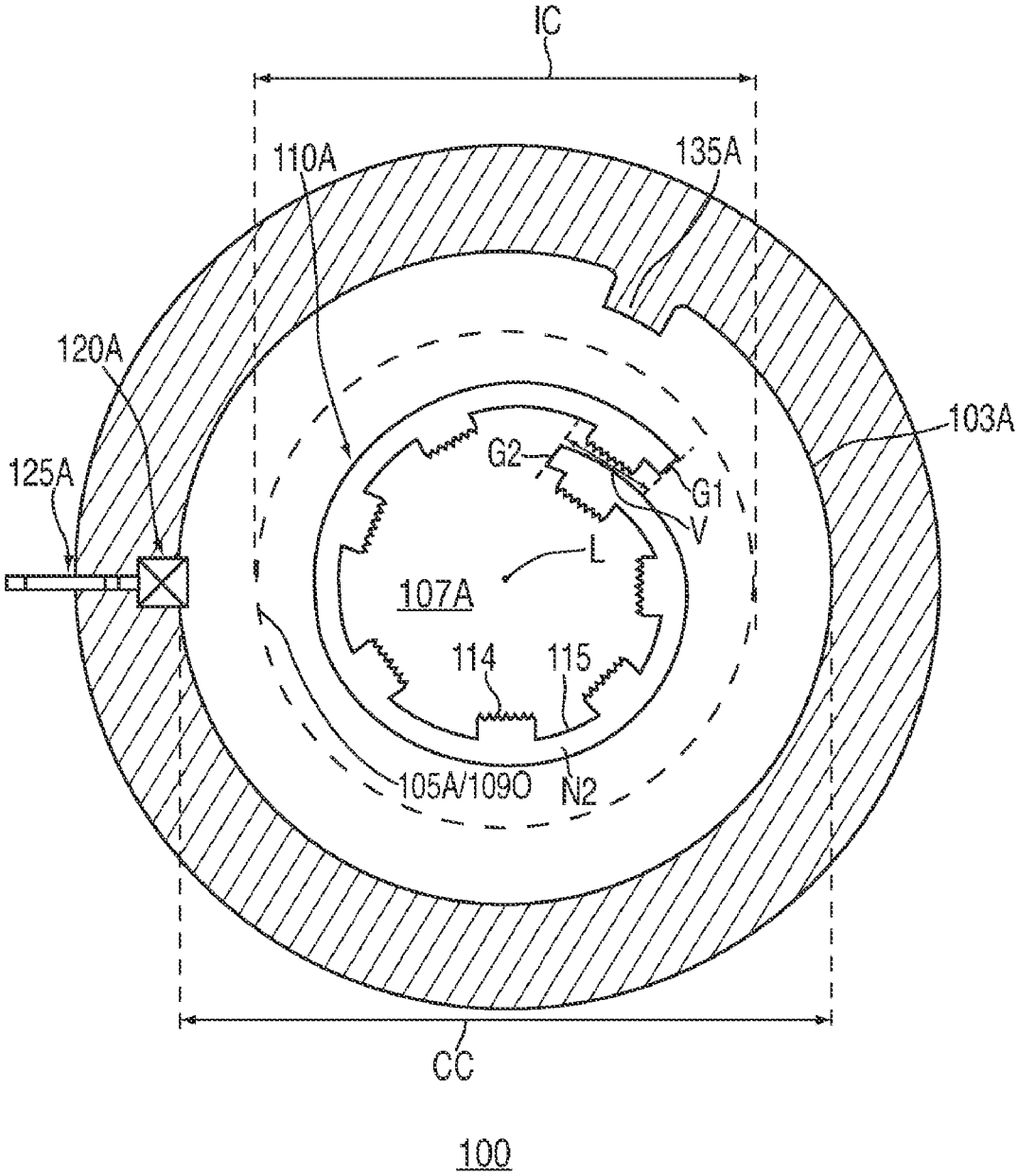
FIG. 4A is a vertical cross-sectional view of a first portion of the jack assembly of FIGS. 1-2A and 4, taken from line IVA-IVA of FIG. 4, in accordance with some embodiments of the invention.
Figure 4B:
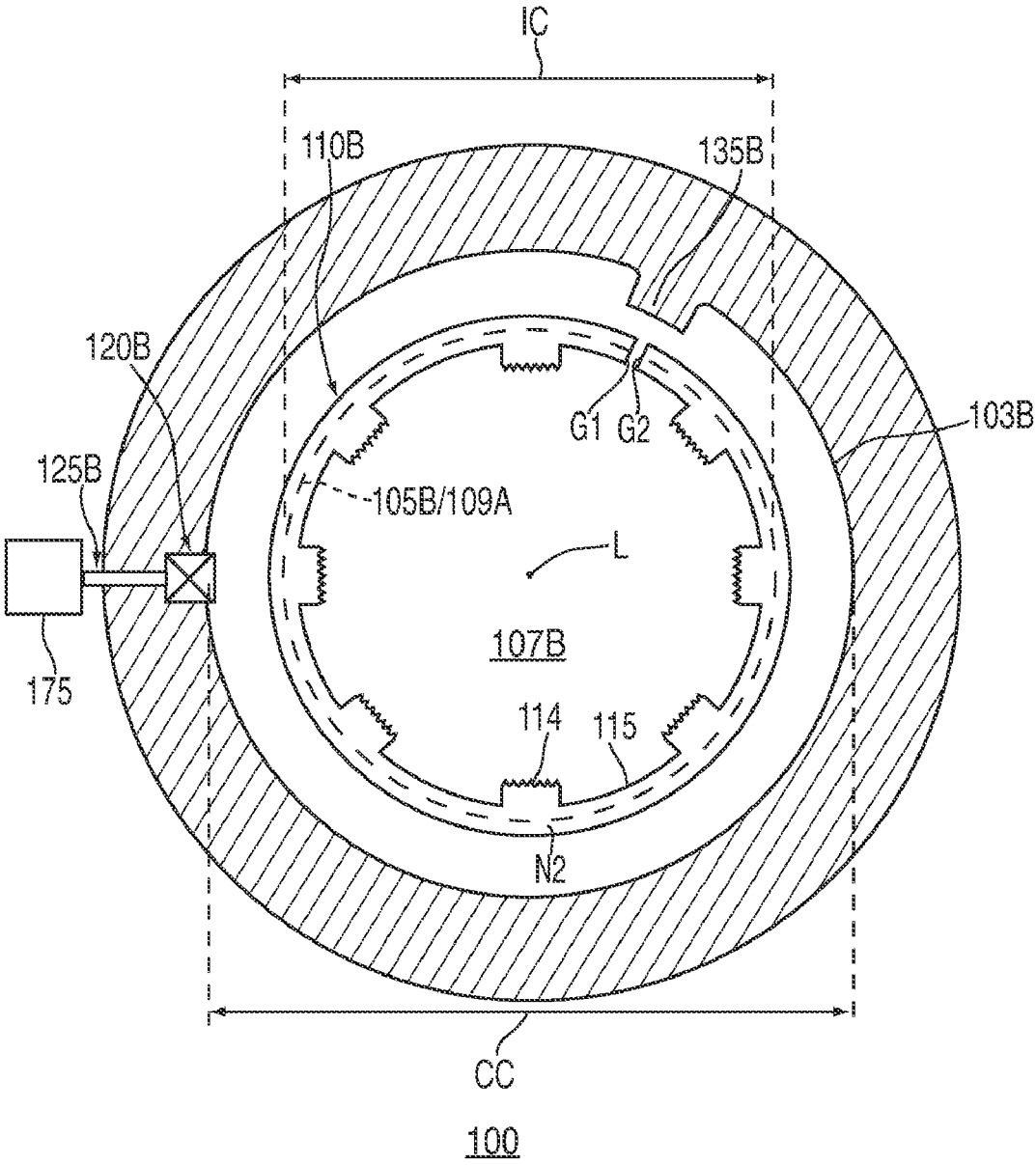
FIG. 4B is a vertical cross-sectional view of a second portion of the jack assembly of FIGS. 1-2A, 4, and 4A, taken from line IVB-IVB of FIG. 4, in accordance with some embodiments of the invention.
Figure 4C:
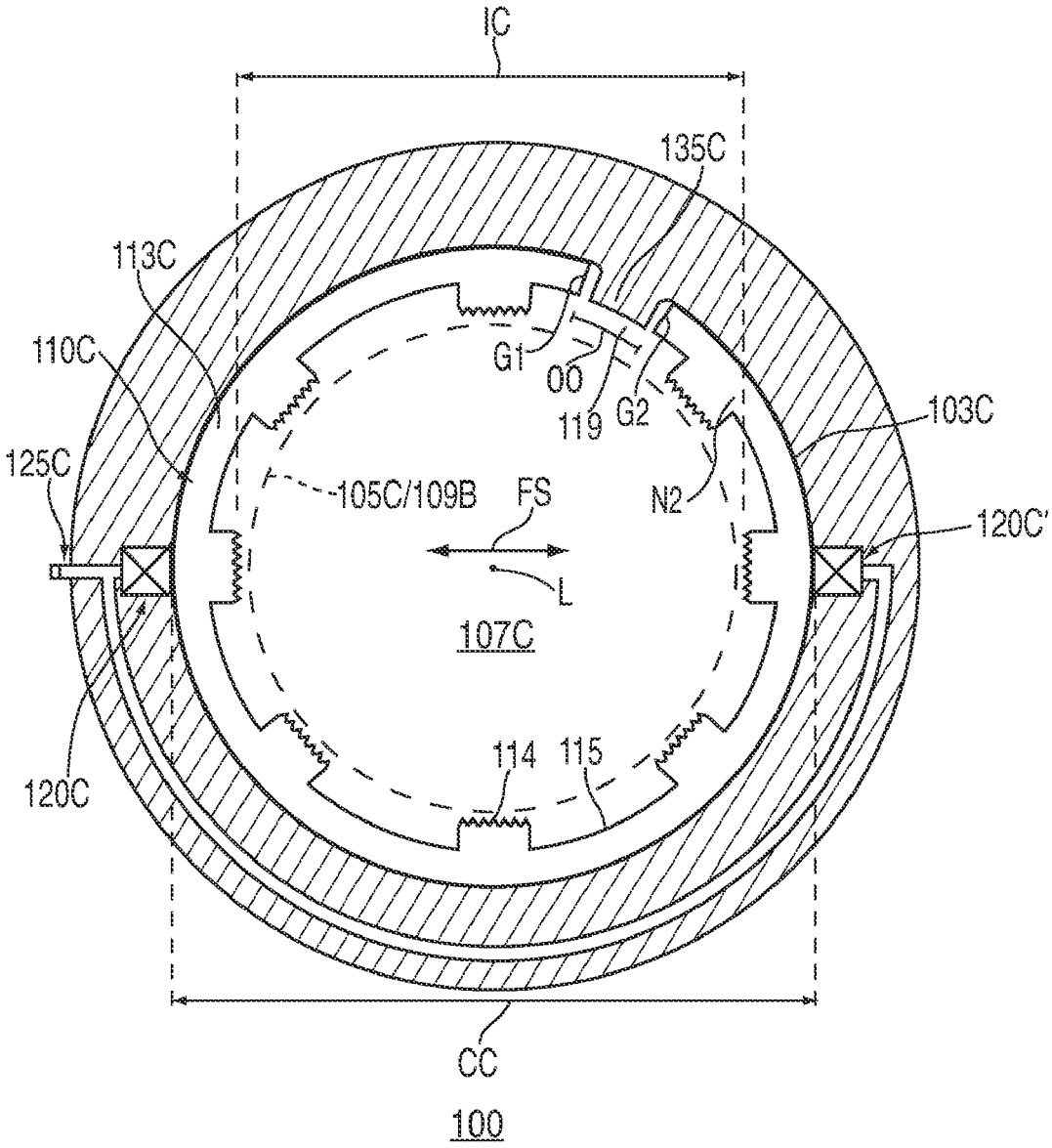
FIG. 4C is a vertical cross-sectional view of a second portion of the jack assembly of FIGS. 1-2A and 4-4B, taken from line IVC-IVC of FIG. 4, in accordance with some embodiments of the invention.

As shown in FIGS. 2 and 4-4C, for example, jack assembly 102 may include an enclosure 104 that may define a jack cavity 106. Cavity 106 may include a jack opening 101 adjacent housing opening 191 of device 100. A plug, such as plug 94, may be inserted in the direction of arrow I through housing opening 191 and into cavity 106 of enclosure 104. In some embodiments, jack enclosure 104 may be a portion of housing 190 of device 100. For example, enclosure 104 and top wall 192 may be a single structure. Alternatively, enclosure 104 may be a separate entity that may be coupled to housing 190 or any other portion of device 100 in any suitable way, including, but not limited to, adhesive, tape, heat staking, a mechanical fastener, such as a screw, or any other approach. Enclosure 104 can be formed from a single component (e.g., molded), or from several components combined and assembled to create enclosure 104. For example, enclosure 104 may include at least two portions, each of which may define a portion of cavity 106 (e.g., two halves which may be combined). As another example, enclosure 104 may be formed from a tubular section defining cavity 106. Any suitable approach may be used to assemble distinct portions of enclosure 104, including, but not limited to, adhesive, tape, heat staking, a mechanical fastener, such as a screw, or any other approach.

Enclosure 104 may be made out of any suitable material using any suitable manufacturing process. For example, enclosure 104 may be manufactured from a plastic (e.g., nylon), a composite material, or any other suitable material. Cavity 106 may be formed in enclosure 104 in any suitable way, including molding, cutting, or any other suitable process.

Jack assembly 102 may include one or more jack contacts 110 that may be operative to electrically couple one or more electronic device components of device 100 with one or more plug contact regions of a plug inserted into cavity 106 (e.g., plug electrical contact regions 91 of plug 94). Each jack contact 110 may be positioned with respect to enclosure 104 such that, when a plug is fully inserted into cavity 106, each jack contact 110 may electrically couple with a respective plug contact of the plug. For example, as shown in FIG. 2, jack assembly 102 may include jack contacts 110A, 110B, and 110C, each of which may electrically couple with a respective plug contact 91A, 91B, and 91C of plug 94 when plug 94 is positioned within cavity 106.

Enclosure 104 may be shaped to provide cavity 106 that may include one or more jack contact cavity regions 107 and one or more insulator cavity regions 109. As shown in FIGS. 2 and 4, each insulator cavity region 109 may be positioned between two adjacent contact cavity regions 107 or between a contact cavity region 107 and housing opening 191. Each contact cavity region 107 may be configured to hold a respective jack contact 110. Moreover, each contact cavity region 107 may be configured to hold at least a portion of a respective plug contact 91 when plug 94 is positioned within cavity 106. Each insulator cavity region 109 may be configured to hold a respective portion of plug 94 extending between two plug contacts 91 or between a plug contact 91 and base region 95 when plug 94 is positioned within cavity 106. As shown in FIG. 4, for example, at least one contact cavity region 107 may have a height CH and a cross-sectional area at least partially defined by a cross-sectional length CC. Moreover, as also shown in FIG. 4, for example, at least one insulator cavity region 109 may have a height IH and a cross-sectional area at least partially defined by a cross-sectional length IC, which may also at least partially define the cross-sectional area of jack opening 101 and/or housing opening 191.

Moreover, each jack contact 110 may be electrically coupled to at least one electronic component 175 of device 100 via at least one jack pad 120 and at least one associated wire 125. For example, as shown in FIGS. 2 and 4-4C, jack assembly 102 may include wires 125A, 125B, and 125C, each of which may be electrically coupled to an electronic device component 175 and to at least one respective jack pad 120A, 120B, and 120C. Moreover, at least when plug 94 is fully inserted into cavity 106, each one of jack contacts 110A, 110B, and 110C may be electrically coupled to at least one respective jack pad 120A, 120B, and 120C. Therefore, when plug 94 is inserted into cavity 106, each plug contact 91 may electrically couple with a respective jack contact 110, which may be electrically coupled to a device component 175 via a respective jack pad 120 and wire 125. Each jack pad 120 may be assembled and positioned in jack assembly 102 in any suitable way. For example, each jack pad 120 may be surface mounted to a portion of enclosure 104. Therefore, when a plug is inserted into cavity 106 of jack assembly 102, an electrical path may be created for transferring signals between each plug contact and at least one device component 175 of device 100 via a respective jack contact 110, jack pad 120, and wire 125.

Electronic device component 175 may be any suitable electronic component of device 100 capable of receiving electrical signals from a plug coupled to jack 102 and/or capable of transmitting electrical signals to a plug coupled to jack 102. For example, device component 175 may be a circuit board of electronic device 100, which may provide one or more attachment points to other electronic components of electronic device 100 (e.g., input component 170 and/or output component 180 of FIG. 1). Generally, most of the basic circuitry and components required for electronic device 100 to function may be onboard or coupled to the circuit board (e.g., via one or more cables, bond pads, leads, terminals, cables, wires, contact regions, etc.). Such electronic components may include, but are not limited to, a processor (not shown), a storage device (not shown), communications circuitry (not shown), a bus (not shown), and a power supply (not shown), each of which may be coupled to the circuit board, for example. In other embodiments, device component 175 may itself be such an electronic component, including, but not limited to, a processor, a storage device, communications circuitry, a bus, a power supply, an input component (e.g., input component 170), an output component (e.g., input component 180), and the like. Each wire 125 of each jack pad 120 may be electrically coupled to a different electronic component 175 than each of the other wires 125. Alternatively or additionally, each wire 125 of each jack pad 120 may be electrically coupled to the same electronic component 175 as each of the other wires 125 of each of the other jack pads 120.

In some embodiments, one or more jack contacts 110 may be substantially cylindrical and may define a hollow tube through which a plug may be inserted. One or more portions of the jack contact defining the hollow tube may be configured to deflect when physically contacted by the plug, thereby creating one or more electrically conductive contact regions between jack assembly 102 and a plug inserted therein.

Each jack contact 110 may be provided using any suitable electrically conductive material, including, but not limited to, copper and copper alloys (e.g., beryllium copper, titanium copper, and copper nickel silicone), carbon, phosphor bronze, a composite material, or any other suitable material.

Figure 3A:
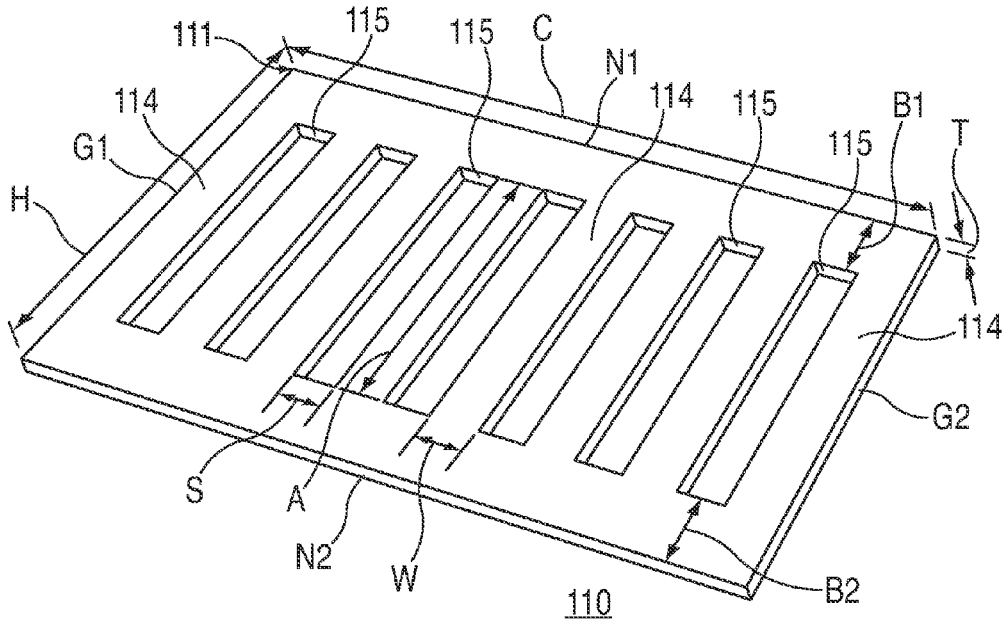
FIG. 3A is a top, front, right perspective view of a jack contact of the jack assembly of FIGS. 1-2A, after a first step in a creation process, in accordance with some embodiments of the invention.

In some embodiments, jack contact 110 may be initially formed from a substantially flat sheet of material. The sheet of material may be embossed or otherwise provided with a curved or otherwise deflectable region. Then, the sheet may be rolled about an axis such that the sheet may form an annular or partially annular tube or cylindrical structure about and along the axis. For example, as shown in FIG. 3A, jack contact 110 may be formed from a sheet 111 having a length C, a width H, and a thickness T. Sheet 111 may be substantially flat and may be made from a single material or a combination of multiple materials.

Figure 3B:
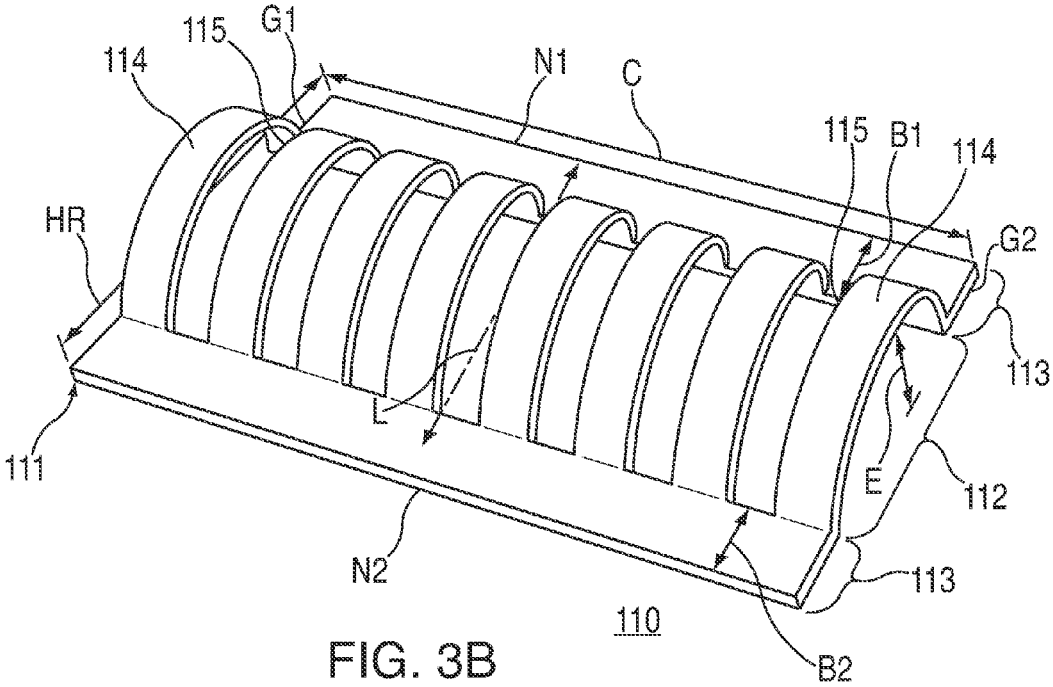
FIG. 3B is a top, front, right perspective view of the jack contact of FIG. 3A, after a second step in the creation process, in accordance with some embodiments of the invention.

Next, sheet 111 may be embossed or otherwise provided with a curved or deflected region along width H between a first edge N1 (e.g., a top edge) and a second edge N2 (e.g., a bottom edge) of sheet 111. For example, as shown in FIG. 3B, sheet 111 may be provided with a deflected region 112 extending between first and second end regions 113. Deflected region 112 may be formed to have a deflection distance E (e.g., a deflection distance E out of the plane of original sheet 111), which may thereby reduce the physical width of sheet 111 to reduced width HR. In some embodiments, as shown in FIG. 3B, for example, deflected region 112 may span only a portion of reduced width HR of sheet 111 and may be flanked by end regions 113 that may not be deflected. Alternatively, in other embodiments, deflected region 112 may span substantially the entirety of reduced width HR of sheet 111 between edges N1 and N2 such that end regions 113 are minimal or substantially non-existent. Similarly, in some embodiments, deflected region 112 may span only a portion of length C of sheet 111. Alternatively, as shown in FIG. 3B, for example, deflected region 112 may span the entire length C of sheet 111 from a first edge G1 to a second edge G2.

Next, sheet 111 may be rolled or otherwise formed into a substantially cylindrical or tubular shape. For example, edge G1 and edge G2 (e.g., left edge and right edge) of sheet 111 may be rolled or otherwise folded towards one another about an axis L, which may be parallel to edges G1 and G2, as shown in FIG. 3B, to form a substantially cylindrical or tubular jack 110.

Figure 3C:
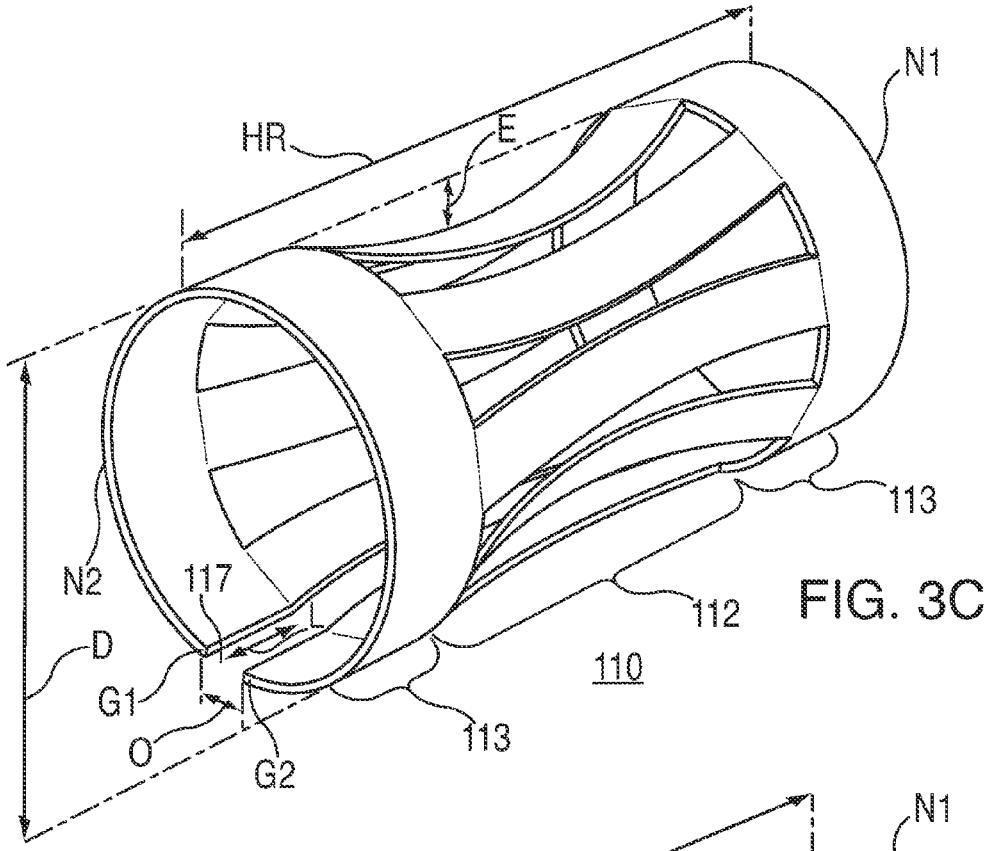
FIG. 3C is a top, front, right perspective view of the jack contact of FIGS. 3A and 3B, after a third step in the creation process, in accordance with some embodiments of the invention.
Figure 3D:
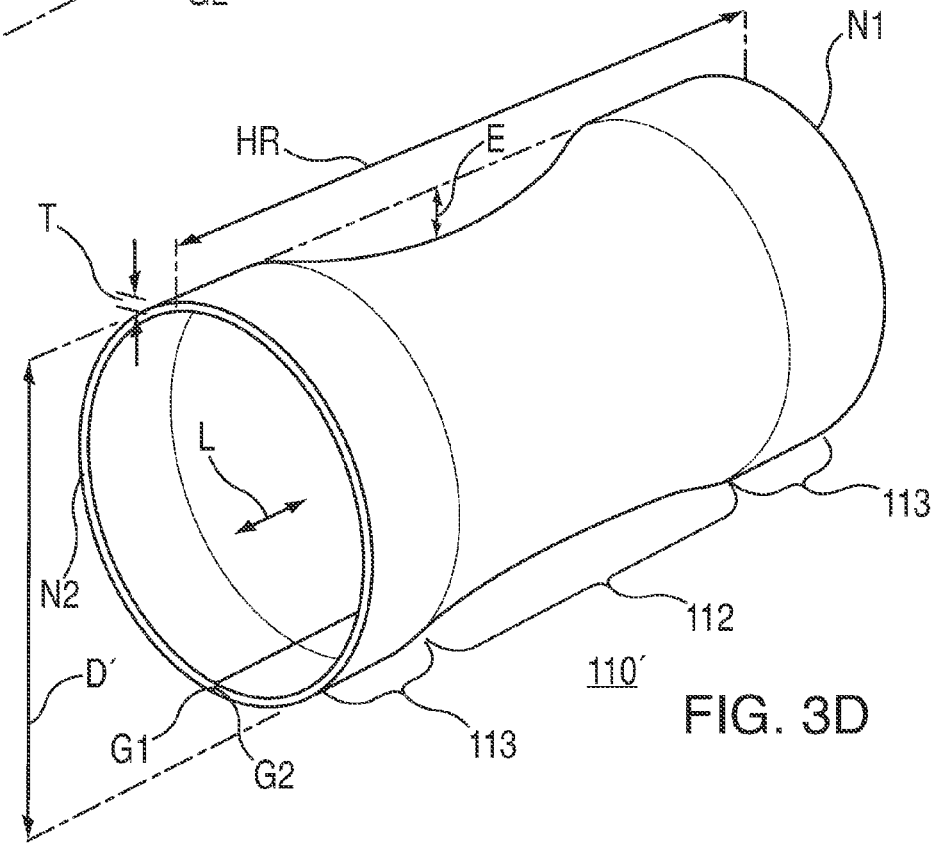
FIG. 3D is a top, front, right perspective view of a jack contact of FIG. 12A, similar to FIG. 3C, but in accordance with some other embodiments of the invention.

In some embodiments, edge G1 and edge G2 of sheet 111 may actually be joined to one another, such that the actual structure may be that of jack contact 110' of FIG. 3D. Edges G1 and G2 of sheet 111 may be coupled to one another using any suitable approach, including the use of adhesives, mechanical holding features, welding, or any other process. In such embodiments, jack contact 110' may form a hollow tube extending completely about axis L and extending along axis L between a first end defined by edge N1 and a second end defined by edge N2. Moreover, in such embodiments, at least one portion of deflected region 112 may extend away from at least one end region 113 and towards axis L.

When edges G1 and G2 are coupled to one another, the ends of jack contact 110' defined by edges N1 and N2 may each be completely annular or otherwise continuous about axis L. That is, each end of jack contact 110' may be continuous and may define a completely annular end of the hollow tube. For example, as shown in FIG. 3D, an end of jack contact 110' (e.g., the end defined by edge N2) may have a cross-sectional area that may be at least partially defined by a cross-sectional length D'. In the embodiments where jack contact 110' may have a completely annular end defined by edge N2 to be of a circular shape, as shown in FIG. 3D, for example, cross-sectional length D' may be a diameter of the circle having a circumference defined by length C of sheet 111 (i.e., cross-sectional length D' may be equal to length C divided by H). However, jack contact 110' may have a completely continuous end defined by edge N2 to be of any other suitable shape about axis L, such as oval, rectangular, triangular, or any other suitable shape, in which case the end of jack contact 110' may have a cross-sectional area that may be at least partially defined by any other suitable cross-sectional length D'. An opposite end (e.g., defined by edge N1), may also be of any suitable shape about axis L, such as circular, oval, rectangular, triangular, and the like. Similarly, a cross-sectional area of a jack contact at any point along the length of the contact along axis L may be any suitable shape, such as circular or triangular.

Alternatively, in other embodiments, edge G1 and edge G2 of sheet 111 may be rolled or otherwise folded towards one another about axis L, as shown in FIG. 3B, to form only a partially annular jack 110. For example, edge G1 and edge G2 of sheet 111 may not be joined to one another, such that the actual structure may be that of jack contact 110 of FIG. 3C. Edges G1 and G2 of sheet 111 may remain spaced from one another by an opening 117 defined by a distance O. In such embodiments, jack contact 110 may also form a hollow tube extending partially about axis L and extending along axis L between a first end defined by edge N1 and a second end defined by edge N2. Moreover, in such embodiments, at least one portion of deflected region 112 may extend away from at least one end region 113 and towards axis L.

However, when edges G1 and G2 are not coupled to one another, the ends of jack contact 110 defined by edges N1 and N2 may each be C-shaped or any other suitable broken or non-continuous shape about axis L that may be provided with an opening. For example, as shown in FIG. 3C, an end of jack contact 110 (e.g., the end defined by edge N2 and opening 117) may have a cross-sectional area that may be at least partially defined by a cross-sectional length D. In the embodiments where jack contact 110 may have an end defined by edge N2 and opening 117 to be of a circular shape (e.g., C-shaped), as shown in FIG. 3C, for example, cross-sectional length D may be a diameter of the circle having a circumference defined by length C of sheet 111 plus distance O of opening 117 (i.e., cross-sectional length D may be equal to the sum of length C and distance O, divided by H). However, jack contact 110 may have an end defined by edge N2 and opening 117 to be of any other suitable shape, such as oval, rectangular, triangular, or any other suitable shape, in which case the end of jack contact 110 may have a cross-sectional area that may be at least partially defined by any other suitable cross-sectional length D. An opposite end (e.g., defined by edge N1 and an opening 117), may also be of any suitable shape, such as circular, oval, rectangular, triangular, and the like. Similarly, a cross-sectional area of a jack contact at any point along the length of the contact may be any suitable shape, circular or otherwise.

In some embodiments, jack contact 110 may be provided with an opening 117 in its undeformed state having an opening distance O that may be a certain proportion of length C, such that jack contact 110 may provide a tube about various sized portions of axis L. For example, opening distance O may be in the range of 1% to 10% of length C. In some embodiments, opening distance O may be in the range of 3% to 8% of length C. In some embodiments, opening distance O may be 5.5% of length C. Of course, opening distance O may be widely varied with respect to length C and is not limited to these examples. For example, opening distance O may be greater than 10% of length C or less than 1% of length C.

In some embodiments, rather than creating deflected region 112 before folding edge G1 and edge G2 of sheet 111 towards one another, deflected region 112 may be formed after sheet 111 has been shaped into a hollow tube. Moreover, in some embodiments, rather than providing a tubular jack contact 110 with at least substantially continuous walls along axis L (i.e., along width HR of sheet 111) as shown in FIG. 3D, one or more slots may be formed through sheet 111. For example, as shown in FIGS. 3A-3C, one or more slots 115 may be formed through thickness T of sheet 111. Each slot 115 may be provided at least partially along or through deflected region 112 between first edge N1 and second edge N2. The remaining sheet material between two adjacent slots 115 or between a slot 115 and edge G1 or edge G2 may create a band portion 114 of jack contact 110. At least a portion of each band 114 may provide at least a portion of deflected region 112.

Each slot 115 may have any suitable shape and size and may differ from the shape and size of any other slot 115. For example, a slot 115 may be substantially rectangular and may include a width S and a length A. Moreover, each band 114 may have any suitable shape and size and may differ from the shape and size of other bands 114. For example, a band 114 may be substantially rectangular and may include a width W and a length A. As shown in FIGS. 3A-3C, for example, sheet 111 may be provided with seven slots 115 and, therefore, eight bands 114, although any other suitable number of bands 114 and slots 115 may be provided, such as two or less, or nine or more. In some embodiments, each slot 115 may be equally spaced from one another along length C between edges G1 and G2 of sheet 111. Slots 115 and tabs 114 may combine to create a fine mesh like region along jack contact 110 and jack contact 110 may provide a stent like structure. Moreover, each slot 115 may be spaced from edge N1 by a first distance B1 and from edge N2 by a second distance B2. In some embodiments, distances B1 and B2 may each define the length of a respective end region 113 along width H that may flank deflected region 112, such that deflected region 112 may be defined by the length of slot 115 and, thus, band 114.

Each slot 115 may be formed using any suitable process, including, but not limited to, laser cutting and the like. In some embodiments, rather than creating one or more slots 115 before forming deflected region 112, deflected region 112 may be formed after one or more slots 115 have been formed through sheet 111. Moreover, in other embodiments, rather than creating one or more slots 115 before rolling sheet 111 into a tubular structure, sheet 111 may be rolled before forming one or more slots 115. It is to be understood that, although slots 115 are only illustrated and described with respect to jack contact 110 of FIGS. 3A-3C, in some embodiments, jack contact 110' of FIG. 3D may also be provided with one or more slots 115. It is also to be understood that, although slots 115 are illustrated and described with respect to jack contact 110 of FIGS. 3A-3C, in some embodiments, jack contact 110 of FIGS. 3A-3C may not include any slots 115.

In some embodiments, rather than forming a jack contact from a sheet 111, a jack contact may be produced by starting with a single, unitary tube of material, and then removing selected material until only the material shown in FIG. 3C or FIG. 3D may remain. For example, laser cutting or any other suitable process may be used to remove material from a single, unitary starting tube in order to produce jack contact 110 of FIG. 3C and/or jack contact 110' of FIG. 3D. One or more deflected regions 112 may be formed in the starting tube before and/or after material is removed from the tube.

The geometries of jack contact 110 may be varied based on the type of plug jack assembly 102 is to receive. For example, jack assembly 102 is configured to receive and communicate with a 3.5 millimeter (e.g., ⅛ inch) miniature plug. Therefore, in some embodiments, a jack contact 110 may be formed from a sheet 111 or tube of material having a length C that may be in the range of 11.0 millimeters to 13.0 millimeters. In some embodiments, length C may be in the range of 11.5 millimeters to 12.5 millimeters. In some embodiments, length C may be about 12.0 millimeters. Of course, length C of jack contact 110 can be widely varied and is not limited to these examples. For example, length C can be greater than 13.0 millimeters or less than 11.0 millimeters. In some embodiments, a jack contact 110 may be formed from a sheet 111 or tube of material having a height H that may be in the range of 2.0 millimeters to 5.0 millimeters. In some embodiments, height H may be in the range of 3.0 millimeters to 4.0 millimeters. In some embodiments, height H may be about 3.5 millimeters. Of course, height H of jack contact 110 can be widely varied and is not limited to these examples. For example, height H can be greater than 5.0 millimeters or less than 2.0 millimeters. In some embodiments, a jack contact 110 may be formed from a sheet 111 or tube of material having a thickness T that may be in the range of 0.02 millimeters to 0.12 millimeters. In some embodiments, thickness T may be in the range of 0.05 millimeters to 0.09 millimeters. In some embodiments, thickness T may be about 0.07 millimeters. Of course, thickness T of jack contact 110 can be widely varied and is not limited to these examples. For example, thickness T can be greater than 0.12 millimeters or less than 0.02 millimeters.

Moreover, in some embodiments, a jack contact 110 may be provided with a deflected region having a deflection distance E that may be in the range of 0.01 millimeters to 0.04 millimeters. In some embodiments, deflection distance E may be in the range of 0.02 millimeters to 0.03 millimeters. In some embodiments, deflection distance E may be about 0.025 millimeters. Of course, deflection distance E of jack contact 110 can be widely varied and is not limited to these examples. For example, deflection distance E can be greater than 0.04 millimeters or less than 0.01 millimeters. In some embodiments, a jack contact 110 may be provided with one or more slots 115 having a slot width S that may be in the range of 0.02 millimeters to 0.08 millimeters. In some embodiments, slot width S may be in the range of 0.04 millimeters to 0.06 millimeters. In some embodiments, slot width S may be about 0.05 millimeters. Of course, each slot width S of jack contact 110 can be widely varied and is not limited to these examples. For example, slot width S can be greater than 0.08 millimeters or less than 0.02 millimeters. Similarly, in some embodiments, a jack contact 110 may be provided with one or more tabs 114 having a tab width W that may be in the range of 0.02 millimeters to 0.08 millimeters. In some embodiments, tab width W may be in the range of 0.04 millimeters to 0.06 millimeters. In some embodiments, tab width W may be about 0.05 millimeters. Of course, each tab width W of jack contact 110 can be widely varied and is not limited to these examples. For example, tab width W can be greater than 0.08 millimeters or less than 0.02 millimeters. Moreover, in some embodiments, a jack contact 110 may be provided with one or more tabs 114 and slots 115 having a tab/slot length A that may be a certain proportion of width H. For example, tab/slot length A may be in the range of 70% to 90% of width H. In some embodiments, tab/slot length A may be in the range of 75% to 85% of width H. In some embodiments, tab/slot length A may be 80% of width H. Of course, each tab/slot length A may be widely varied with respect to width H and is not limited to these examples. For example, tab/slot length A may be greater than 90% of width H or less than 70% of width H.

As shown in FIGS. 2 and 4-4C, one or more jack contacts 110 may be inserted into cavity 106 and positioned with respect to enclosure 104 of jack assembly 102. Each jack contact 110 may provide one or more electrically conductive regions for transferring signals with a respective conductive region of a plug that may be positioned within cavity 106 (see, e.g., conductive plug regions 91 of plug 94 within cavity 106 of FIG. 2). As mentioned, enclosure 104 may be shaped to provide one or more jack contact cavity regions 107 and one or more insulator cavity regions 109. As shown in FIG. 4, for example, each contact cavity region 107 may have a cross-sectional area that may be at least partially defined by a cross-sectional length CC, and each insulator cavity region 109 may have a cross-sectional area that may be at least partially defined by a cross-sectional length IC, which may also at least partially define the cross-sectional area of jack opening 101 and/or housing opening 191. In some embodiments, as shown in FIG. 4, for example, the cross-sectional area of a contact cavity region 107 at least partially defined by a cross-sectional length CC may be larger than the cross-sectional area of an adjacent insulator cavity region 109 at least partially defined by a cross-sectional length IC, such that a jack contact 110 may be held within the contact cavity region 107.

As mentioned, one or more jack contacts 110 may be inserted into a respective contact cavity region 107 of cavity 106. In order to be positioned within a contact cavity region 107, a jack contact 110 may first be deformed so as to pass through an adjacent insulator cavity region 109, jack opening 101, and/or housing opening 191, at least one of which may have a smaller cross-sectional area than the cross-sectional area of the contact cavity region 107. For example, as shown in FIGS. 2, 4, and 4A, a first jack contact 110A may be positioned within a first contact cavity region 107A. However, in some embodiments, in order to introduce jack contact 110A into contact cavity region 107A, contact 110A may first be passed through housing opening 191, jack opening 101, and first insulator cavity region 109O in the direction of arrow I, which may be parallel to axis L. The size of at least one of housing opening 191, jack opening 101, and first insulator cavity region 109O (e.g., length IC) may prevent jack contact 110A from passing therethrough in its undeformed state. Therefore, jack contact 110A may be deformed such that it may pass through housing opening 191, jack opening 101, and/or first insulator cavity region 109O.

As shown in FIGS. 4 and 4A, for example, jack contact 110A may be deformed such that the size of the end of jack contact 110A about its longitudinal axis L may be reduced. For example, jack contact 110 including an opening between ends G1 and G2 (see, e.g., opening 117 of jack contact 110 of FIG. 3C) may be coiled to reduce its cross-sectional area (e.g., the cross-sectional area of jack contact 110 at least partially defined by cross-sectional length D at the end of jack contact 110 defined by edge N2 and opening 117). As shown in FIG. 4A, for example, edges G1 and G2 of contact 110A may be further rolled past one another, such that they may overlap by a coil distance V about axis L. This coiling of jack contact 110A may reduce the cross-sectional area of contact 110A at edge N2 to be less than the cross-sectional area of housing opening 191, jack opening 101, and/or first insulator cavity region 109O, which may be defined by cross-sectional length IC (e.g., as shown in broken line in FIG. 4A).

This coiling of each jack contact 110 from its undeformed state of FIG. 3C to its deformed state of FIGS. 4 and 4A may be accomplished using any suitable approach. For example, a gripping mechanism (not shown) may grab jack contact 110 (e.g., about one or both end regions 113) and may deform jack contact 110 to its deformed state. The gripping mechanism may then insert deformed jack contact 110 in the direction of arrow I, through housing opening 191, jack opening 101, and at least first insulator cavity region 109O, and into the jack cavity region 107 associated with that jack contact 110. Axis L of the jack contact may be maintained in a parallel relationship with the insertion direction of arrow I. The gripping mechanism may then release jack contact 110, thereby allowing jack contact 110 to attempt to return to its undeformed state within its appropriate jack cavity region 107.

For example, deformed jack contact 110A may be inserted in the direction of arrow I, past the edge of enclosure 104 separating first insulator cavity region 109O and jack cavity region 107A (e.g., enclosure edge 105A shown in broken line in FIG. 4A), to the position within jack cavity region 107A, as shown in FIGS. 4 and 4A. Then, jack contact 110A may be allowed to uncoil and attempt to return to its undeformed state within jack cavity region 107A (see, e.g., jack contact 110A of FIG. 2). Similarly, deformed jack contact 110B may be inserted in the direction of arrow I, past the edge of enclosure 104 separating second insulator cavity region 109A and jack cavity region 107B (e.g., enclosure edge 105B shown in broken line in FIG. 4B), to a position within jack cavity region 107B that is similar to the position of jack contact 110A within jack cavity 107A of FIGS. 4 and 4A. Then, jack contact 110B may be allowed to uncoil and attempt to return to its undeformed state within jack cavity region 107B (see, e.g., jack contact 110B of FIG. 2). Moreover, deformed jack contact 110C may be inserted in the direction of arrow I, past the edge of enclosure 104 separating third insulator cavity region 109B and jack cavity region 107C (e.g., enclosure edge 105C shown in broken line in FIG. 4C), to a position within jack cavity region 107C that is similar to the position of jack contact 110A within jack cavity 107A of FIGS. 4 and 4A. Then, jack contact 110C may be allowed to uncoil and attempt to return to its undeformed state within jack cavity region 107C (see, e.g., jack contact 110C of FIG. 2).

In some embodiments, rather than coiling a jack contact 110 including an opening between ends G1 and G2 such that the ends may overlap by a coil distance V about axis L, jack contact 110 may be deformed by simply moving ends G1 and G2 closer together (e.g., by reducing distance O of opening 117). Based on the size to which jack contact 110 must be deformed and based on the size of distance O of opening 117 in the undeformed state of the jack contact, the jack contact may be deformed for insertion into cavity 106 by further rolling edges G1 and G2 of the jack contact towards one another about axis L, and not necessarily by rolling edges G1 and G2 past one another in a coiling fashion.

Once a deformed jack contact 110 is allowed to attempt to return to its undeformed state within a jack cavity region 107, jack contact 110 may first uncoil to an "intermediate" state, such that edges G1 and G2 may be substantially adjacent one another, and such that coil distance V and distance O of opening 117 may each be substantially reduced and/or nonexistent. For example, as shown in FIGS. 4 and 4B, jack contact 110B may be in such an intermediate state. In some embodiments, this intermediate state of jack contact 110B may provide jack contact 110B with a cross-sectional area at edge N2 that may be at least equal to, if not greater than, the cross-sectional area of second insulator cavity region 109A, which may be defined by cross-sectional length IC (e.g., as shown in broken line in FIG. 4B). This uncoiling or expansion of jack contact 110B from its deformed state to its intermediate state away from axis L may allow jack contact 110B to extend past enclosure edge 105B and, thus, further into jack cavity region 107B.

Finally, when a jack contact 110 may further be allowed to change from its intermediate state to a "cavity undeformed" state within a jack cavity region 107, jack contact 110 may further uncoil, such that edges G1 and G2 may separate from one another. For example, as shown in FIGS. 4 and 4C, jack contact 110C may expand from its intermediate state to a cavity undeformed state, such that edges G1 and G2 may be separated from one another by an opening 119 having a distance OO. In some embodiments, this cavity undeformed state of jack contact 110C may provide jack contact 110C with a cross-sectional area at edge N2 that may be greater than the cross-sectional area of third insulator cavity region 109B, which may be defined by cross-sectional length IC (e.g., as shown in broken line in FIG. 4C). Moreover, in some embodiments, this cavity undeformed state of jack contact 110C may provide jack contact 110C with a cross-sectional area at edge N2 that may be substantially equal to the cross-sectional area of third jack cavity region 107C, which may be defined by cross-sectional length CC (e.g., as shown in broken line in FIG. 4C).

For example, the cross-sectional area at edge N2 of jack contact 110C in its cavity undeformed state may be determined by distance OO of opening 119 between edges G1 and G2. In some embodiments, if cross-sectional length CC of third jack cavity 107C is greater than or at least equal to cross-sectional length D of undeformed jack contact 110 of FIG. 3C, then the cavity undeformed state of jack contact 110C of FIG. 4C may be equal to the fully undeformed state of jack contact 110 FIG. 3C. Therefore, distance OO of opening 119 of the cavity undeformed state of jack contact 110C of FIG. 4C may be equal to distance O of opening 117 of the undeformed state of jack contact 110 of FIG. 3C. In such embodiments, jack cavity region 107C may allow jack contact 110C to expand away from longitudinal axis L to its fully undeformed state.

However, if cross-sectional length CC of third jack cavity 107C is less than cross-sectional length D of undeformed jack contact 110 of FIG. 3C, for example, then the cavity undeformed state of jack contact 110C of FIG. 4C may not be equal to the fully undeformed state of jack contact 110 FIG. 3C. Therefore, distance OO of opening 119 of the cavity undeformed state of jack contact 110C of FIG. 4C may be smaller than distance O of opening 117 of the fully undeformed state of jack contact 110 of FIG. 3C. In such embodiments, jack cavity region 107C may prevent jack contact 110C from expanding away from longitudinal axis L to its fully undeformed state.

As mentioned, in some embodiments, a jack contact 110 in its cavity undeformed state may not be expanded to its fully undeformed state. Therefore, an expansion force may be exerted by at least a portion of the jack contact 110. For example, an expansion force may be exerted by jack contact 110 in a direction away from longitudinal axis L when the deformed state of jack contact 110 reduces the distance between portions of jack contact 110 and longitudinal axis L (e.g., as described with respect to the deformed state of jack contact 110A of FIG. 4A). This expansion force may hold at least one portion of jack contact 110 against another component of jack assembly 102. For example, as shown in FIGS. 2, 4, and 4C, an expansion force in the direction of arrows FS away from longitudinal axis L may hold at least one end region 113C of jack contact 110C in its cavity undeformed state against side enclosure wall 103C of jack cavity region 107C and, thus, against at least one jack pad 120C.

In other embodiments, the expansion force may be exerted by jack contact 110 in a direction parallel to longitudinal axis L when the deformed state reduces the distance of width HR of jack contact 110, for example. Such an expansion force may also hold at least one portion of jack contact 110 against another component of jack assembly 102. For example, as shown in FIG. 2, an expansion force in the direction of arrows FU parallel to longitudinal axis L may hold at least one end region 113A of jack contact 110A in its cavity undeformed state against at least one of top enclosure wall 108B and bottom enclosure wall 108A of jack cavity region 107A.

In some embodiments, the expansion force exerted by a jack contact 110 in its cavity deformed state may maintain jack contact 110 in a fixed position with respect to enclosure 103. This may obviate the need to physically attach jack contact 110 to enclosure 104 or any other component of jack assembly 102, for example, despite plug 94 being inserted into and removed from cavity 106. In other embodiments, the cavity undeformed state of a jack contact may be its fully undeformed state, such that the jack contact may not exert an expansion force. In such embodiments, the jack contact may be contained, perhaps loosely, within its jack cavity region 107. For example, enclosure edge 105 may define a lower enclosure ledge on which a jack contact may rest in its cavity undeformed state.

Once a jack contact 110 has been positioned within a jack cavity region 107 and has reached its cavity undeformed state, at least a portion of jack contact 110 may be electrically coupled to at least one jack pad 120. In some embodiments, one or more jack pads 120 may be flush with an enclosure wall extending along a portion of a jack cavity region 107. For example, as shown in FIGS. 2, 4, and 4C, a jack pad 120C may be flush with enclosure wall 103C of jack cavity region 107C. Moreover, as shown in FIGS. 2, 4, and 4C, and as mentioned, an expansion force of jack contact 110C in the direction of arrows FS may hold at least a portion of jack contact 110C (e.g., at least one end region 113C) in physical contact with enclosure wall 103C of jack cavity region 107C, and thus jack pad 120C. This physical contact between end region 113C of jack contact 110C and jack pad 120C may also electrically couple jack pad 120C with jack contact 110C. In some embodiments, more than one jack pad 120C may be positioned with respect to enclosure 104 for electrically coupling with jack contact 110C. For example, as shown in FIGS. 2, 4, and 4C, a first jack pad 120C may be provided flush with a portion of side wall 103C adjacent electronic device component 175, and a second jack pad 120C' may be provided flush with a portion of side wall 103C opposite first jack pad 120C. Both jack pads 120C may be coupled by wire 125C to device component 175.

In other embodiments, one or more jack pads 120 may extend through an enclosure wall and by a distance into a jack cavity region 107. For example, as shown in FIGS. 2, 4, and 4B, a jack pad 120B may extend through enclosure 104 (e.g., through enclosure side wall 103B of jack cavity region 107B) and into jack cavity region 107B. As shown in FIG. 2, for example, the cavity deformed state of jack contact 110B may hold at least a portion of jack contact 110B (e.g., at least one end region 113B) in physical contact with jack pad 120B extending through enclosure side wall 103B of jack cavity region 107B. This physical contact between end region 113B of jack contact 110B and jack pad 120B may also electrically couple jack pad 120B with jack contact 110B. In some embodiments, more than one jack pad 120B may be positioned with respect to enclosure 104 for electrically coupling with jack contact 110B. For example, as shown in FIG. 2, a first jack pad 120B may be provided through a portion of side wall 103B adjacent electronic device component 175, and a second jack pad 120B' may be provided through a portion of bottom wall 108B' adjacent first jack pad 120B. Both jack pads 120B may be coupled by wire 125B to device component 175.

An additional component may be provided between a portion of jack contact 110B and enclosure 104 to physically couple jack contact 110B to enclosure 104. For example, as shown in FIG. 2, a physical connection component 124B may be coupled to both a portion of side wall 103B and a portion of jack contact 110B. Physical connection component 124B may be any suitable component and may be provided using any suitable process. For example, physical connection component 124B may be an adhesive, a screw, or any other mechanical element that may be provided before or after jack contact 110B has been inserted into jack cavity region 107B.

In some embodiments, the cavity deformed state of a jack contact 110 within a jack cavity region 107 may not directly position a portion of that jack contact 110 in contact with a jack pad 120 so as to be electrically coupled to that jack pad. Rather, an additional electrically conductive component may be positioned between a jack pad and a jack contact in its cavity deformed state. For example, as shown in FIGS. 2, 4, and 4A, a jack pad 120A may be flush with enclosure wall 103A of jack cavity region 107A. Moreover, as shown in FIG. 2, and as mentioned, an expansion force of jack contact 110A in the direction of arrows FU may hold at least a portion of jack contact 110A (e.g., an end region 113A) in its cavity deformed state in physical contact with enclosure wall 108A of jack cavity region 107A. However, jack contact 110A in its cavity deformed state may not be held in physical contact with jack pad 120A. Therefore, an electrically conductive component 122A may be provided between jack pad 120A and jack contact 110A in its cavity deformed state such that jack pad 120A may be electrically coupled to jack contact 110A.

Electrically conductive component 122A may be any suitable conductive component and may be provided using any suitable process. For example, electrically conductive component 122A may be solder provided during a solder reflow process before or after jack contact 110A has been inserted into jack cavity region 107A. In some embodiments, more than one jack pad 120A may be positioned with respect to enclosure 104 for electrically coupling with jack contact 110A. For example, as shown in FIG. 2, a second jack pad 120A' may be provided to extend through enclosure wall 103A of jack cavity region 107A. Both jack pads 120A may be coupled by wire 125A to device component 175. However, jack contact 110A in its cavity deformed state may not be held in physical contact with jack pad 120A'. Therefore, a second electrically conductive component 122A' may be provided between jack pad 120A' and jack contact 110A in its cavity deformed state such that jack pad 120A' may be electrically coupled to jack contact 110A.

As mentioned, when a jack contact 110 may change from its intermediate state to its cavity undeformed state within a jack cavity region 107, jack contact 110 may further uncoil, such that edges G1 and G2 may separate from one another. For example, as shown in FIGS. 4 and 4C, jack contact 110C may expand to its cavity undeformed state, such that edges G1 and G2 may be separated from one another by opening 119 having distance OO. Opening 119 of jack contact 110C may be oriented with respect to enclosure 104 such that opening 119 may not align with a jack pad 120, because opening 119 may not be able to electrically couple with a jack pad 120 like a material portion of jack contact 110C (e.g., end region 113C of jack contact 110C). Therefore, enclosure 104 may be provided with one or more orientation tabs 135 for properly aligning each jack contact 110 within its jack cavity region 107 with one or more jack pads 120.

For example, as shown in FIG. 4C, an orientation tab 135C may extend from enclosure side wall 103C into jack cavity region 107C. Orientation tab 135C may be sized and positioned such that, when jack contact 110C may change from its intermediate state to its cavity undeformed state within jack cavity region 107C, at least a portion of orientation tab 135C may fit into opening 119 between edges G1 and G2 of jack contact 110C. This may orient at least one conductive material portion of jack contact 110C in its cavity undeformed state in a specific orientation with respect to at least one portion of jack assembly 102, such as with respect to one or more jack pads 120C.

Each jack cavity region may be provided with one or more orientations tabs 135 (see, e.g., orientation tab 135B of jack cavity region 107B of FIG. 4B and orientation tab 135A of jack cavity region 107A of FIG. 4A).

Figure 2A:
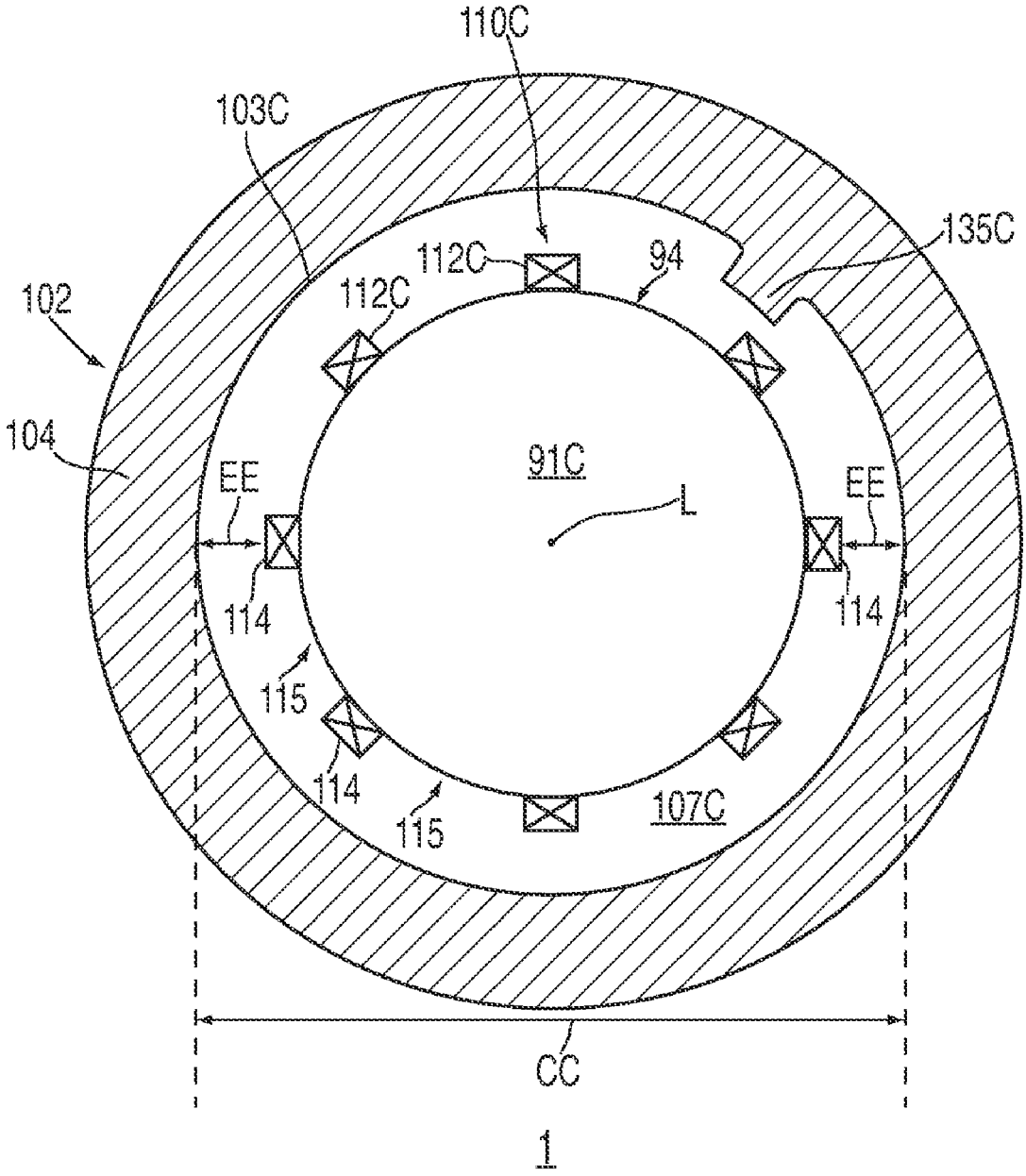
FIG. 2A is a vertical cross-sectional view of a first portion of the jack assembly and plug assembly of FIGS. 1 and 2, taken from line IIA-IIA of FIG. 2, in accordance with some embodiments of the invention.

As mentioned, each jack contact 110 of jack assembly 102 may be positioned in its cavity undeformed state within a jack cavity region 107 of enclosure 104 and may be electrically coupled to at least one jack pad 120 when a plug 94 is inserted into cavity 106 of jack assembly 102. Thus, at least one plug electrical contact region 91 of plug 94 may electrically couple with at least one portion of a jack contact 110 for transferring signals therebetween. However, in some embodiments, jack contact 110 may electrically couple with a plug electrical contact region 91 at multiple regions about the plug. For example, as shown in FIG. 2, for example, multiple points or portions of deflected region 112C of jack contact 110C may contact and electrically couple with respective points or portions of plug contact region 91C of plug 94. If jack contact 110C is similar to jack contact 110' of FIG. 3D including no slots 115, then deflected region 112C may be a substantially continuous wall portion that may contact and electrically couple with a respective continuous portion of plug contact region 91C of plug 94 that may extend about some or all of plug contact region 91C (e.g., about axis L). Alternatively, if jack contact 110C is similar to jack contact 110 of FIG. 3C including one or more slots 115, as shown in FIG. 2A, for example, then deflected region 112C may include one or more distinct bands 114, each of which may be positioned about axis L and may contact and electrically couple with a respective distinct portion of plug contact region 91C of plug 94.

Moreover, each deflected region 112 may extend away from an end region 113 towards axis L and may exert a tension force against a plug contact region 91 when plug 94 is inserted into jack assembly 102 through that jack contact 110. For example, as shown in FIGS. 2 and 2A, when plug contact region 91C is positioned within the hollow of jack contact 110C, jack contact 110C may be shaped such that at least a portion of deflected region 112C may be deflected away from longitudinal axis L and towards enclosure side wall 103C for accommodating plug 94. As shown, this deflection may reduce the deflection distance E of deflected region 112C to a shorter deflection distance EE. Consequently, deflected region 112C may exert a tension force on plug contact region 91C (e.g., towards axis L), which may maintain plug 94 in its functional position within jack assembly 102.

In some embodiments, only a first end region 113 and a portion of deflected region 112 extending therefrom and towards axis L may be provided as a jack 110 in assembly 102. For example, only the portion of jack 110B above or below line Z of FIG. 4 may be provided as a jack contact 110. In such embodiments, only one end region 113 may be provided about at least a portion of axis L and a deflected region 112 having a free end 112F may extend therefrom towards axis L. At least a portion of the deflected region 112 (e.g., its free end 112F) may contact plug 94 as it is inserted through the jack contact.

Although FIGS. 2, 2A, and 4-4C are generally described with reference to jack contact 110 of FIG. 3C, it is to be understood that jack contact 110' of FIG. 3D may also be deformed and inserted into a jack cavity region 107 of enclosure 104. For example, each end of jack contact 110' (e.g., the first end defined by edge N1 and the second end defined by edge N2) may each be may be twisted, folded in on itself, or otherwise deformed to reduce the cross-sectional area of each end for positioning within a jack cavity 107.

Jack contacts having various configurations other than those described with respect to FIGS. 2-4C may be provided with substantially cylindrical contact portions for electrically coupling with a plug at multiple positions.

Figure 5:
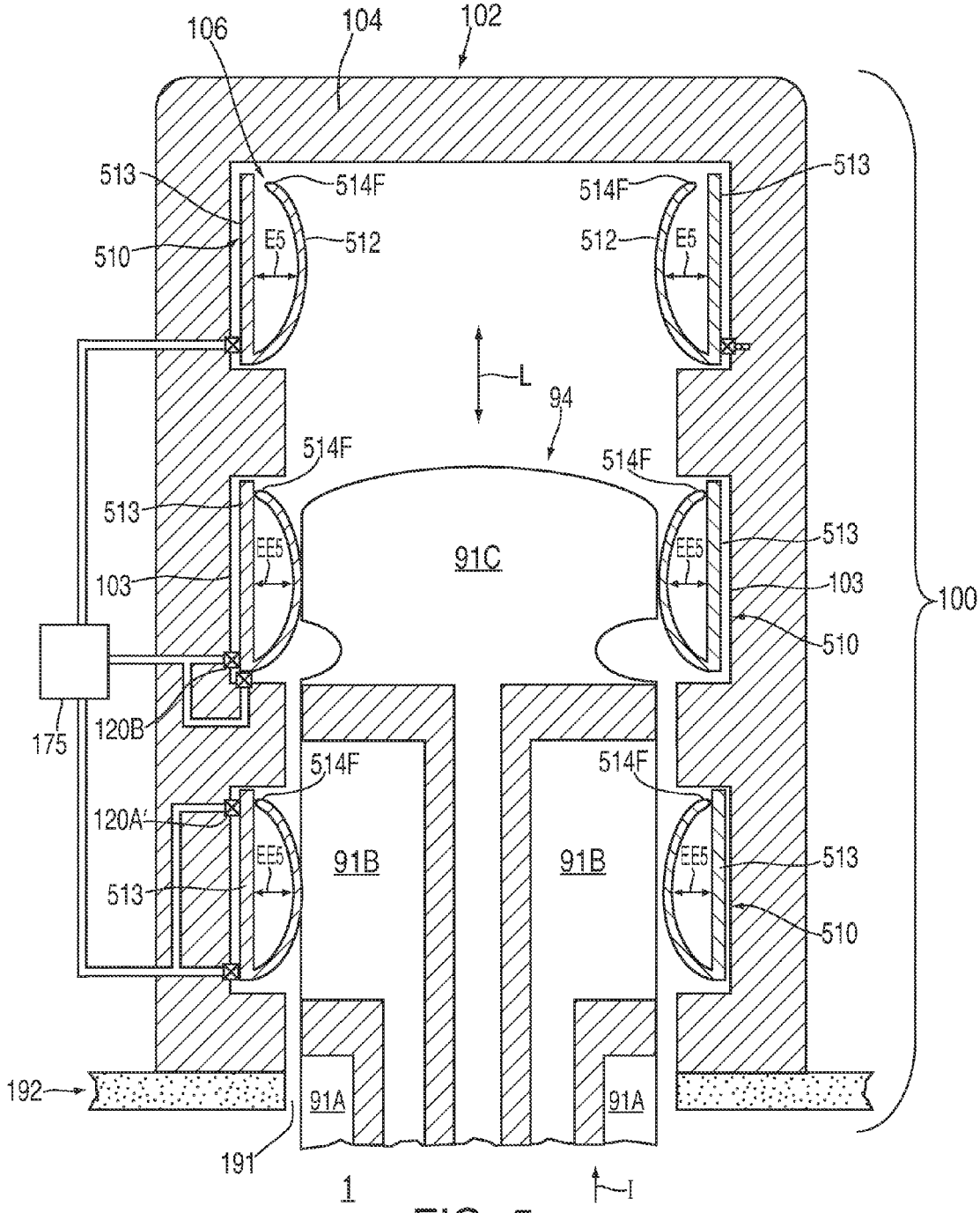
FIG. 5 is a horizontal cross-sectional view of the jack assembly of FIGS. 1-2A and 4-4C, similar to FIG. 2, but with jack contacts in accordance with some other embodiments of the invention.
Figure 5A:
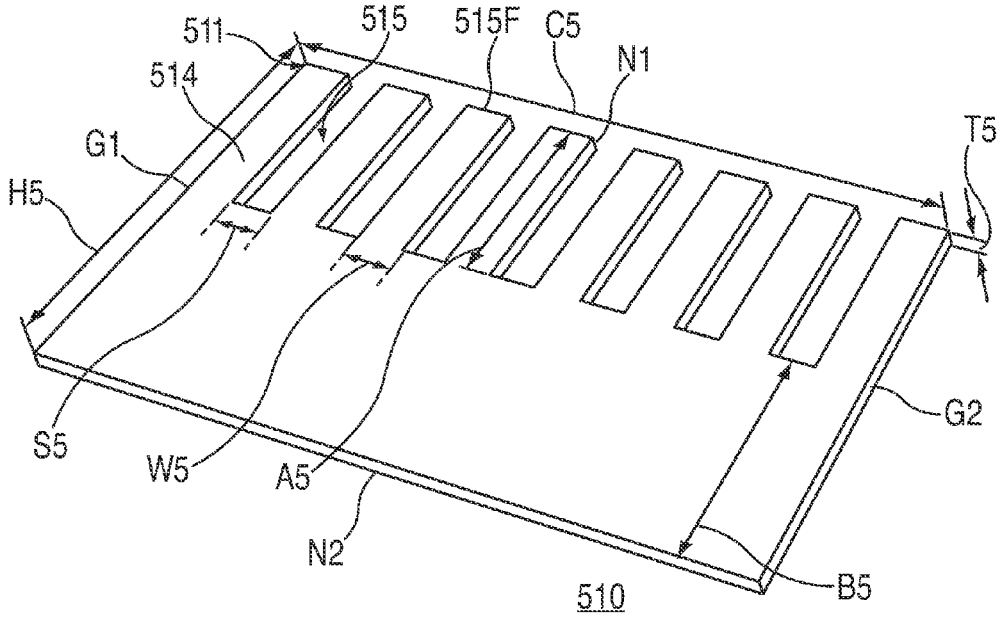
FIG. 5A is a top, front, right perspective view of a jack contact of the jack assembly of FIG. 5, after a first step in a creation process, in accordance with some other embodiments of the invention.
Figure 5B:
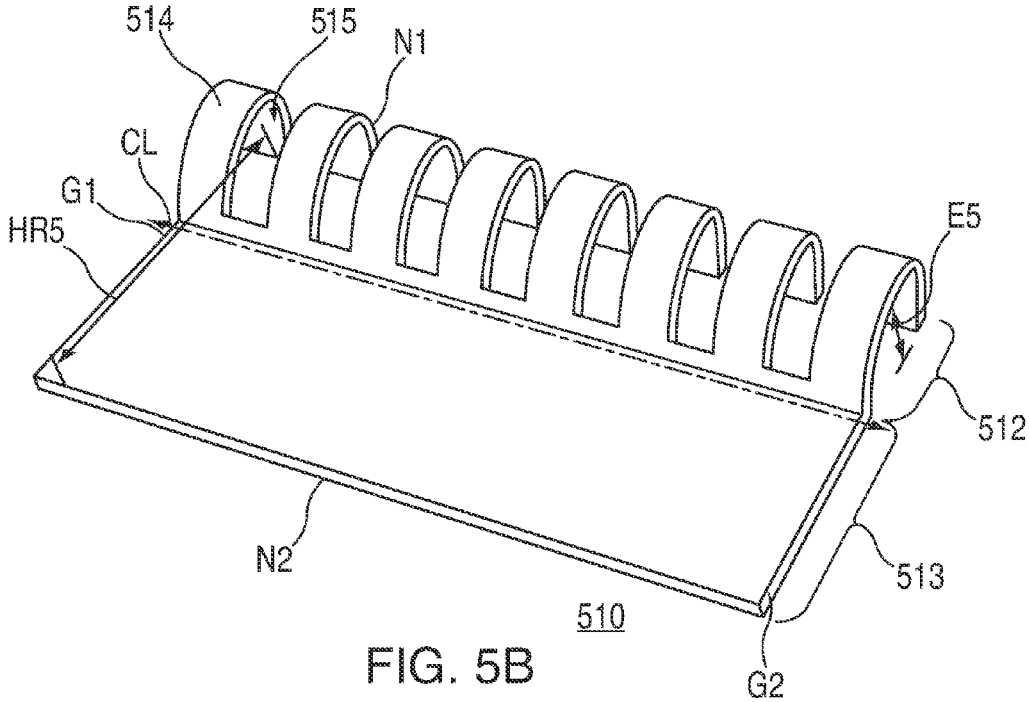
FIG. 5B is a top, front, right perspective view of the jack contact of FIG. 5A, after a second step in the creation process, in accordance with some embodiments of the invention.
Figure 5C:
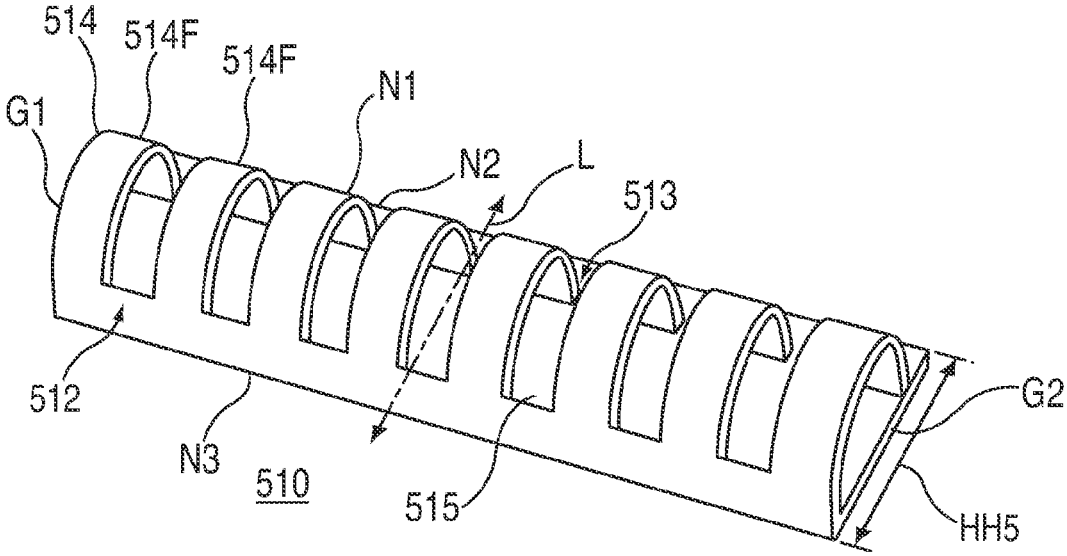
FIG. 5C is a top, front, right perspective view of the jack contact of FIGS. 5A and 5B, after a third step in the creation process, in accordance with some embodiments of the invention.
Figure 5D:
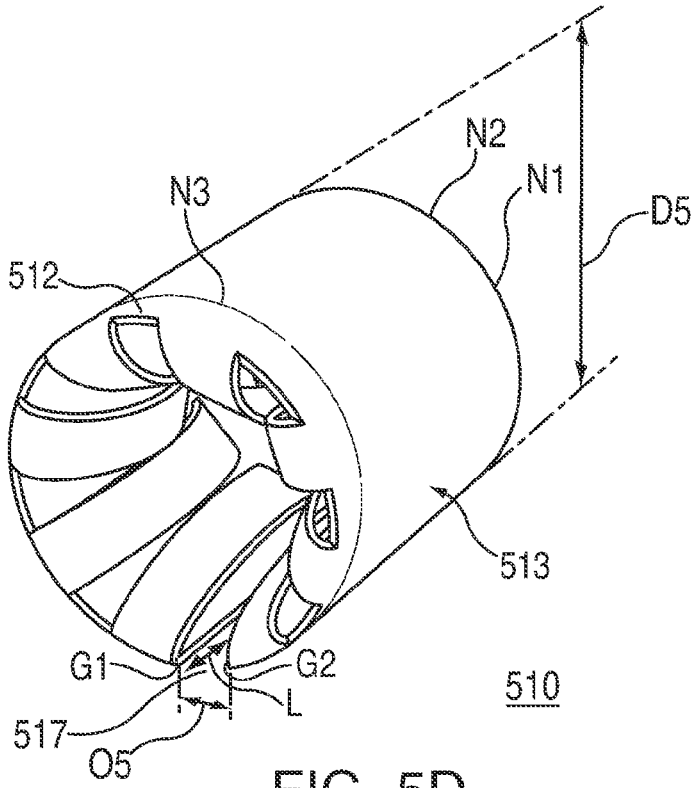
FIG. 5D is a top, front, right perspective view of the jack contact of FIGS. 5A-5C, after a fourth step in the creation process, in accordance with some embodiments of the invention.

For example, as shown in FIGS. 5-5D, jack contacts 510 may be provided to include an end region 513 coupled to a deflectable region 512 having a free end. In some embodiments, like jack 110, jack contact 510 may be initially formed from a substantially flat sheet of material. The sheet of material may be embossed or otherwise provided with a curved or otherwise deflectable region. Then, the deflectable region may be bent towards an end region. The sheet may then be rolled about an axis such that it may form an annular or partially annular tube or cylindrical structure that may be defined about and along the axis by the end region that also surrounds the deflectable region. For example, as shown in FIG. 5A, jack contact 510 may be formed from a sheet 511 having a length C5, a width H5, and a thickness T5. Sheet 511 may be substantially flat and may be made from a single material or a combination of multiple materials.

Next, a portion of sheet 511 may be embossed or otherwise provided with a curved or deflected region along width H5 between a first edge N1 and a second edge N2 of sheet 511. For example, as shown in FIG. 5B, sheet 511 may be provided with a deflected region 512 extending between edge N1 and an end region 513. Deflected region 512 may be formed to have a deflection distance E5 (e.g., a deflection distance E5 out of the plane of original sheet 511), which may thereby reduce the physical width of sheet 511 to reduced width HR5.

Next, sheet 511 may be bent or hemmed substantially at the intersection of deflected region 512 and end region 513 (e.g., edge N3 of FIG. 5C). For example, edge N1 and edge N2 of sheet 511 may be bent or otherwise folded towards one another about an axis CL, which may be parallel to edges N1 and N2, as shown in FIG. 5B, to form a substantially doubled-over structure, as shown in FIG. 5C, which may have a hemmed height HH5 between edge N3 and edge N1 and/or edge N2.

Next, sheet 511 may be rolled or otherwise formed into a substantially cylindrical or tubular shape. For example, edge G1 and edge G2 of sheet 511 may be rolled or otherwise folded towards one another about an axis L, which may be parallel to edges G1 and G2, as shown in FIG. 5C, to form a substantially cylindrical or tubular jack 510 defined by an outer structure provided by end region 513 and an inner structure provided by deflected region 512.

In some embodiments, similar to jack contact 110' of FIG. 3D, edge G1 and edge G2 of sheet 511 may actually be joined to one another (not shown). Alternatively, and similarly to jack contact 110 of FIG. 3C, edge G1 and edge G2 of sheet 511 may be rolled or otherwise folded towards one another about axis L, as shown in FIG. 5D, to form only a partially annular jack 510. For example, edge G1 and edge G2 of sheet 511 may not be joined to one another, such that the actual structure may be that of jack contact 510 of FIG. 5D. Edges G1 and G2 of sheet 511 may remain spaced from one another by an opening 517 defined by a distance O5. In such embodiments, jack contact 510 may also form a hollow tube along and about axis L between a first end defined by edge N1 and/or edge N2, and a second end defined by edge N3. However, when edges G1 and G2 are not coupled to one another, the ends of jack contact 510, which may be defined at one end by edges N1 and N2 and at the other end by edge N3, may each be C-shaped or any other suitable broken or non-continuous shape provided with an opening. For example, as shown in FIG. 5D, an end of jack contact 510 (e.g., the end defined by edge N3 and opening 517) may have a cross-sectional area that may be at least partially defined by a cross-sectional length D5.

In some embodiments, rather than creating deflected region 512 before folding edge N1 and edge N2 of sheet 511 towards one another, deflected region 512 may be formed after sheet 511 has been shaped into a doubled-over structure. Moreover, in some embodiments, rather than creating deflected region 512 before folding edge G1 and edge G2 of sheet 511 towards one another, deflected region 512 may be formed after sheet 511 has been shaped into a cylindrical structure.

Furthermore, in some embodiments, rather than providing a tubular jack contact 510 with at least substantially continuous walls along deflected region 512, one or more slots may be formed through sheet 511. For example, as shown in FIGS. 5A-5D, one or more slots 515 may be formed through thickness 5T of sheet 511. Each slot 515 may be provided at least partially along or through deflected region 512 between first edge N1 and third edge N3. The remaining sheet material between two adjacent slots 515 or between a slot 515 and edge G1 or edge G2 may create a band portion 514 of jack contact 510 having a free end 514F.

Each slot 515 may have any suitable shape and size and may differ from the shape and size of other slots 515. For example, a slot 515 may be substantially rectangular and may include a width S5 and a length A5. Moreover, each band 514 may have any suitable shape and size and may differ from the shape and size of other bands 514. For example, a band 514 may be substantially rectangular and may include a width W5 and a length A5. As shown in FIGS. 5A-5D, for example, sheet 511 may be provided with seven slots 515 and, therefore, eight bands 514, although any other suitable number of bands 514 and slots 515 may be provided. In some embodiments, each slot 515 may be equally spaced from one another along length C5 between edges G1 and G2 of sheet 511. Moreover, each slot 515 may be spaced from edge N2 by a distance B5, which may define the length of end region 513 along width H5.

In some embodiments, rather than creating one or more slots 515 before forming deflected region 512, deflected region 512 may be formed after one or more slots 515 have been formed through sheet 511. Moreover, in other embodiments, rather than creating one or more slots 515 before hemming sheet 511 into a doubled-over structure, sheet 511 may be hemmed before forming one or more slots 515. Furthermore, in other embodiments, rather than creating one or more slots 515 before rolling sheet 511 into a tubular structure, sheet 511 may be rolled before forming one or more slots 515. It is to be understood that, although slots 515 are illustrated and described with respect to jack contact 510 of FIGS. 5A-5D, in some embodiments, deflected region 512 of jack contact 510 of FIGS. 5A-5D may not include any slots 515. Moreover, it is to be understood that, although end region 513 is illustrated and described with respect to FIGS. 5A-5D to not include any slots 515, in some embodiments, end region 513 of jack contact 510 of FIGS. 5A-5D may include one or more slots 515.

Jack contact 510 may be inserted into a jack cavity region 107 of plug assembly 102 in substantially the same way as jack contacts 110 described with respect to FIGS. 2-4C. Moreover, like jack contacts 110, jack contact 510 may electrically couple with a plug electrical contact region 91 of plug 94 at multiple regions about the plug. For example, as shown in FIG. 5, multiple points or portions of deflected region 512 of jack contact 510 may contact and electrically couple with respective points or portions of plug contact region 91C of plug 94. If jack contact 510 is similar to jack contact 110' of FIG. 3D including no slots 515, then deflected region 512 may be a substantially continuous wall portion that may contact and electrically couple with a respective continuous portion of plug contact region 91C of plug 94 that may extend about some or all of plug contact region 91C. Alternatively, if jack contact 510 is similar to jack contact 510 of FIGS. 5A-5D including one or more slots 515, for example, then deflected region 512 may include one or more distinct bands 514, each of which may contact and electrically couple with a respective distinct portion of plug contact region 91C of plug 94.

Moreover, each deflected region 512 may exert a tension force against a plug contact region 91 when plug 94 is inserted into jack assembly 102 through each jack contact 510. For example, as shown in FIG. 5, when plug contact region 91C is positioned within the hollow of jack contact 510, jack contact 510 may be shaped such that at least a portion of deflected region 512 may be deflected away from longitudinal axis L and towards enclosure side wall 103 for accommodating plug 94. As shown, this deflection may reduce the deflection distance E5 of deflected region 512 to a shorter deflection distance EE5. Consequently, deflected region 512 may exert a tension force on plug contact region 91C (e.g., in a direction towards axis L), which may maintain plug 94 in its position within jack assembly 102.

Moreover, as shown in FIG. 5, for example, when plug contact region 91B is positioned within the hollow of jack contact 510, jack contact 510 may be shaped such that at least a portion of deflected region 512, such as free end 514F of a band 514, may be deflected away from longitudinal axis L and towards end region 513 of jack contact 510. In some embodiments, this deflection may bring free end 514F of band 514 into electrical contact with end region 513, which may reinforce the electrical connection between plug 94, band 514, end region 513, and thus a jack pad 120 (see, e.g., jack pad 120A' of FIG. 5).

Figure 6A:
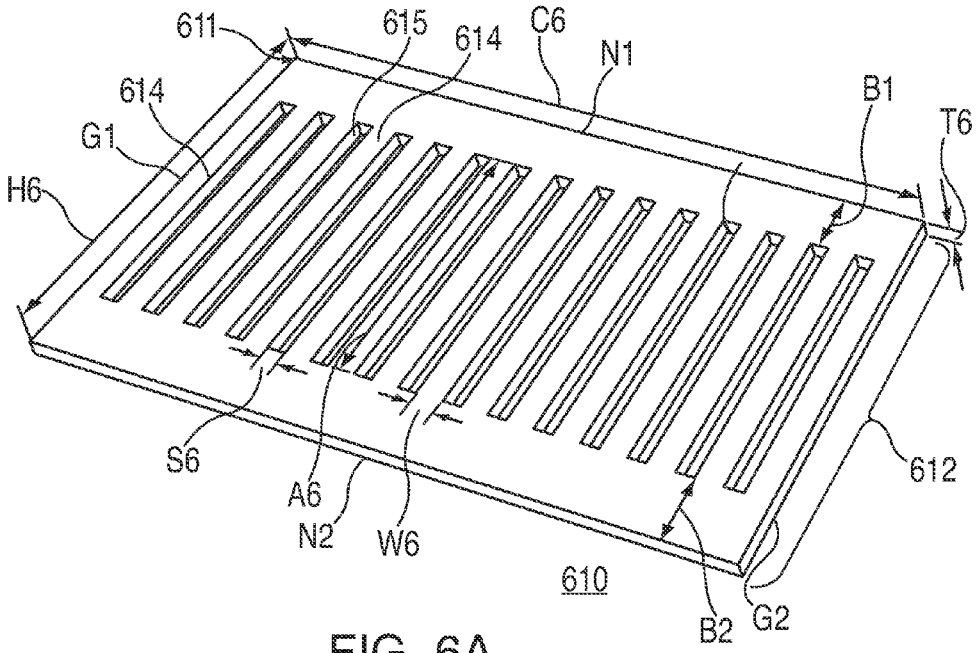
FIG. 6A is a top, front, right perspective view of a jack contact, after a first step in a creation process, in accordance with yet some other embodiments of the invention.

As another example, as shown in FIGS. 6A-6D, a jack contact 610 may be provided to include a cylindrical tube region 612 extending between a first edge N1 and a second edge N2. In some embodiments, like jack 110, jack contact 610 may be initially formed from a substantially flat sheet of material. The sheet of material may then be rolled about an axis such that it may form an annular or partially annular tube or cylindrical structure. For example, as shown in FIG. 6A, jack contact 610 may be formed from a sheet 611 having a length C6, a width H6, and a thickness T6. Sheet 611 may be substantially flat and may be made from a single material or a combination of multiple materials.

Next, sheet 611 may be rolled or otherwise formed into a substantially cylindrical or tubular shape. For example, edge G1 and edge G2 of sheet 611 may be rolled or otherwise folded towards one another about an axis L, which may be parallel to edges G1 and G2, as shown in FIG. 6A, to form a substantially cylindrical or tubular jack 610 extending between ends N1 and N2.

Figure 6B:
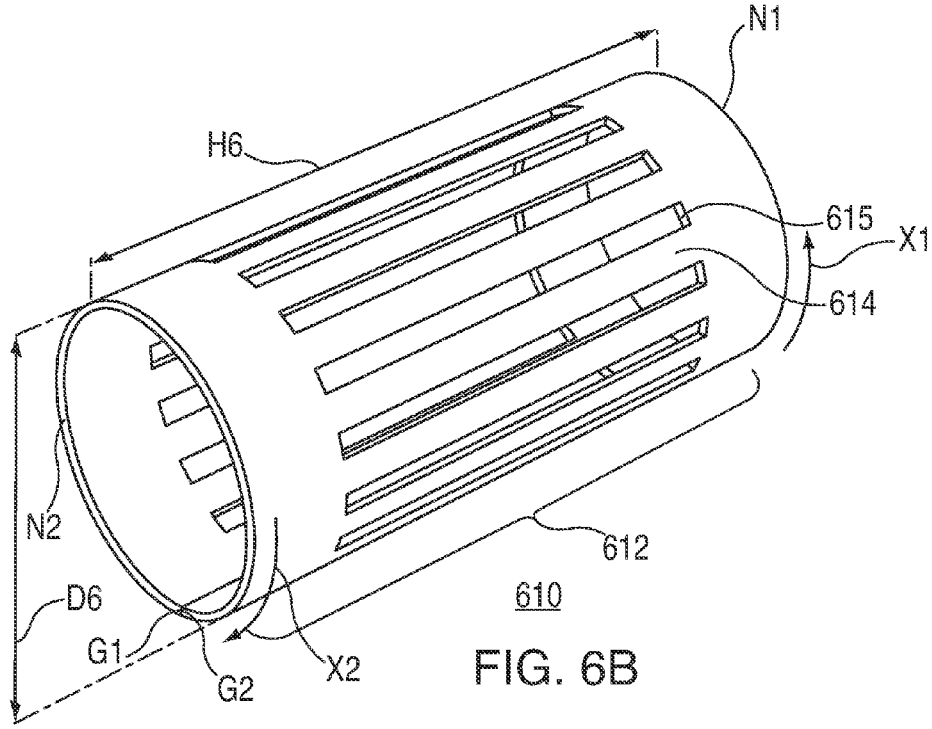
FIG. 6B is a top, front, right perspective view of the jack contact of FIG. 6A, after a second step in the creation process, in accordance with some embodiments of the invention.

In some embodiments, similar to jack contact 110' of FIG. 3D, edge G1 and edge G2 of sheet 611 may actually be joined to one another, as shown in FIG. 6B. Alternatively, and similarly to jack contact 110 of FIG. 3C, edge G1 and edge G2 of sheet 611 may be rolled or otherwise folded towards one another about axis L, but not joined to one another, to form only a partially annular jack 610 (not shown). However, when edges G1 and G2 are coupled to one another, the ends of jack contact 610, which may be defined at one end by edge N1 and at the other end by edge N2, may each be circular or any other continuous shape. For example, as shown in FIG. 6B, an end of jack contact 610 (e.g., the end defined by edge N2) may have a cross-sectional area that may be at least partially defined by a cross-sectional length D6.

In some embodiments, rather than providing a tubular jack contact 610 with at least substantially continuous walls along tube region 612, one or more slots may be formed through sheet 611. For example, as shown in FIGS. 6A and 6B, one or more slots 615 may be formed through thickness 6T of sheet 611. Each slot 615 may be provided along a portion of width H6 between first edge N1 and second edge N2. The remaining sheet material between two adjacent slots 615 or between a slot 615 and edge G1 or edge G2 may create a band portion 614 of jack contact 610.

Each slot 615 may have any suitable shape and size and may differ from the shape and size of other slots 615. For example, a slot 615 may be substantially rectangular and may include a width S6 and a length A6. Moreover, each band 614 may have any suitable shape and size and may differ from the shape and size of other bands 614. For example, a band 614 may be substantially rectangular and may include a width W6 and a length A6. As shown in FIGS. 6A and 6B, for example, sheet 611 may be provided with fifteen slots 615 and, therefore, sixteen bands 614, although any other suitable number of bands 614 and slots 615 may be provided. In some embodiments, each slot 615 may be equally spaced from one another along length C6 between edges G1 and G2 of sheet 611. Moreover, each slot 615 may be spaced from edges N1 and N2 by respective distances B1 and B2.

In some embodiments, rather than creating one or more slots 615 before rolling sheet 611 into a tubular structure, sheet 611 may be rolled before forming one or more slots 615. In some embodiments, rather than forming a jack contact 610 from a sheet 611, a jack contact 610 may be produced by starting with a single, unitary tube of material, and then removing selected material until only the material shown in FIG. 6B may remain. For example, laser cutting or any other suitable process may be used to remove material from a single, unitary starting tube in order to produce jack contact 610 of FIG. 6B.

Figure 6C:
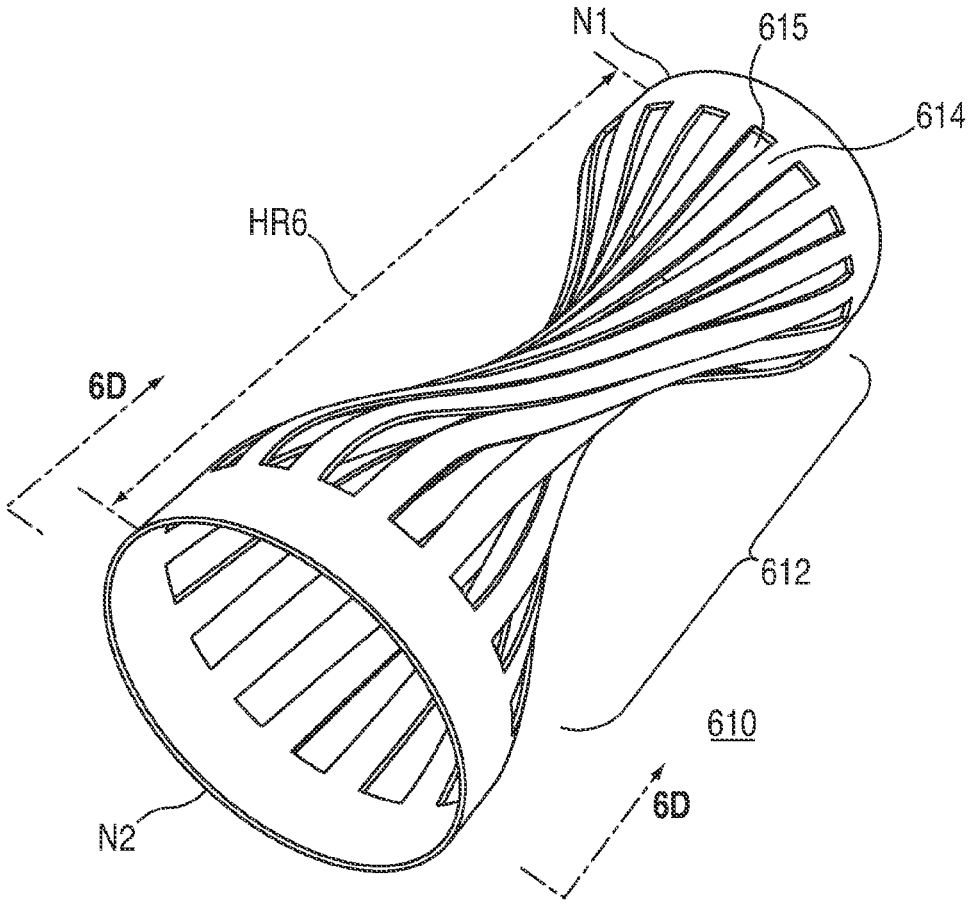
FIG. 6C is a top, front, right perspective view of the jack contact of FIGS. 6A and 6B, after a third step in the creation process, in accordance with some embodiments of the invention.
Figure 6D:
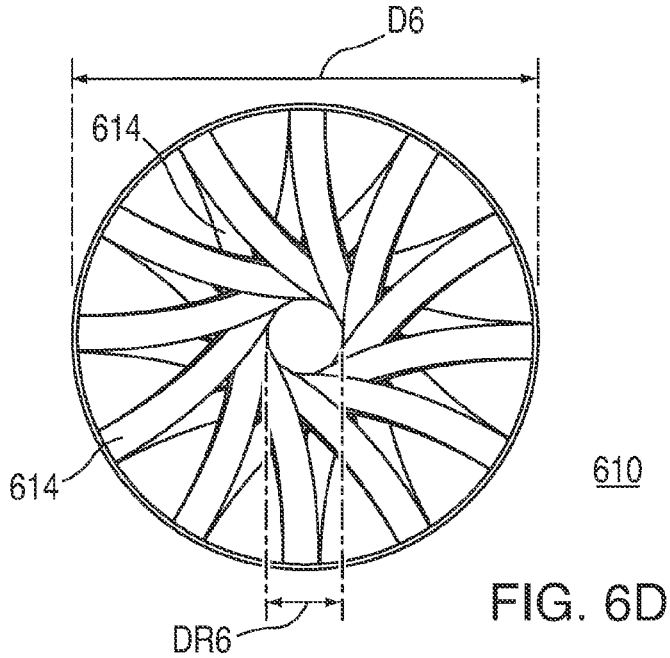
FIG. 6D is a vertical cross-sectional view of the jack contact of FIGS. 6A-6C, taken from line VID-VID of FIG. 6C, in accordance with some embodiments of the invention.

Jack contact 610 may be inserted into a jack cavity region 107 of plug assembly 102 in substantially the same way as jack contacts 110 described with respect to FIGS. 2-4C. Moreover, like jack contacts 110, jack contact 610 may electrically couple with a plug electrical contact region 91 of plug 94 at multiple regions about the plug. However, in some embodiments, ends N1 and N2 of jack contact 610 of FIG. 6B may be twisted in opposite directions (e.g., about axis L) with respect to one another in order to collapse the hollow defined by tube region 612 of contact 610. For example, end N1 may be twisted in the direction of arrow X1 of FIG. 6B and end N2 may be twisted in the direction of arrow X2 of FIG. 6B, such that the hollow of the tube defined by tube region 612 of jack contact 610 may be at least partially collapsed about axis L, as shown in FIGS. 6C and 6D, for example.

This twisting of the ends of jack contact 610 may reduce the length of jack contact 610 from length H6 to a length HR6. This twisted configuration of jack contact 610 may then be inserted into a jack cavity region 107 of jack assembly 102 for receiving a plug. This may provide a jack contact with an at least partially closed or reduced tube hollow passageway when no plug is inserted therein. For example, as shown in FIG. 6D, the cross-sectional area of the hollow tube created by twisted tube portion 612 may be defined by a reduced cross-sectional length DR6. This reduced hollow opening may prevent debris from entering the jack assembly when not in use. Moreover, this collapsed configuration of jack contact 610 may bias jack contact 610 to exert a tension force on a plug when the plug is inserted through the narrowed hollow tube opening of jack contact 610, which may hold the plug within the jack assembly.

In some embodiments, a jack contact may be formed by placing electrically conductive material onto a sheet of deformable foam. For example, each one of sheets 111, 511, and 611 may include a layer of foam material. Then electrically conductive material (e.g., metallic leads) may be formed (e.g., electroformed) onto a surface of the foam material. Next, excess conductive material may be removed (e.g., etched) from the foam surface. The remaining conductive material may form a pattern similar to that of sheet 111 of FIG. 3A, sheet 511 of FIG. 5A, and/or sheet 611 of FIG. 6A. A portion or the entirety of the foam layer adorned with this conductive structure may then be deflected, rolled, folded, and/or otherwise structurally manipulated to form a hollow jack contact having multiple contact regions for receiving and electrically coupling with a plug as described above with respect to FIGS. 1-6D. The foam may be any suitable compliant and/or expandable foam material that may create a hollow jack contact with a hollow opening that can close or narrow when no plug is inserted therein.

Additionally or alternatively, one or more compliant and/or expandable foam portions may be molded or otherwise provided around one or more portions of jack contacts 110, 510, and/or 610. Such foam portions may provide one or more compliant and/or expandable portions of a jack contact while also allowing other portions of the jack contact to be exposed for electrically coupling with a plug.

While there have been described jack assemblies having cylindrical contacts, it is to be understood that many changes may be made therein without departing from the spirit and scope of the invention. It is also to be understood that various directional and orientational terms such as "up" and "down," "front" and "back," "left" and "right," "top" and "bottom," "above" and "under," and the like are used herein only for convenience, and that no fixed or absolute directional or orientational limitations are intended by the use of these words. For example, the jack assemblies of the invention can have any desired orientation. If reoriented, different directional or orientational terms may need to be used in their description, but that will not alter their fundamental nature as within the scope and spirit of the invention. Moreover, it is to be understood that, although electronic devices are described as including connector jack assemblies and accessory devices are described as including connector plug assemblies, any other suitable configuration may be possible. For example, electronic devices may include connector plug assemblies and accessory devices may include connector jack assemblies of the invention.

Those skilled in the art will appreciate that the invention can be practiced by other than the described embodiments, which are presented for purposes of illustration rather than of limitation.

What is claimed is:

1. An electrical connector comprising:
- an enclosure defining a cavity with a longitudinal axis operative to receive an electrical plug;
- a tab coupled to the enclosure; and
- at least a first jack contact positioned in the cavity, the first jack contact comprising:
  - at least a first end region extending about a first portion of the axis between a first edge of the first end region and a second edge of the first end region; and
  - a contact region extending from the first end region towards the axis, wherein:
    - an opening extends about the remaining portion of the axis between the first edge of the first end region and the second edge of the first end region; and
    - at least a portion of the tab is positioned within at least a portion of the opening.

2. The electrical connector of claim 1, wherein the first end region extends completely about the axis before the first jack contact is positioned in the cavity.

3. The electrical connector of claim 1, wherein the contact region is operative to deflect and contact a first conductive region of the plug when the plug is inserted into the cavity.

4. The electrical connector of claim 1, wherein the contact region comprises a plurality of contact bands.

5. The electrical connector of claim 4, wherein:

a first contact band of the plurality of contact bands extends from a first portion of the first end region towards the axis; and a second contact band of the plurality of contact bands extends from a second portion of the first end region towards the axis.

6. The electrical connector of claim 4, wherein:

a first contact band of the plurality of contact bands is operative to contact a first portion of a first conductive region of the plug when the plug is inserted into the cavity; and a second contact band of the plurality of contact bands is operative to contact a second portion of the first conductive region of the plug when the plug is inserted into the cavity.

7. The electrical connector of claim 4, wherein:

a first contact band of the plurality of contact bands is operative to contact a first portion of a first conductive region of the plug and deflect away from the axis when the plug is inserted into the cavity; and a second contact band of the plurality of contact bands is operative to contact a second portion of the first conductive region of the plug and deflect away from the axis when the plug is inserted into the cavity.

8. The electrical connector of claim 1, wherein:

the first jack contact further comprises a second end region extending about at least a second portion of the axis;

the contact region extends between the first end region and the second end region; and a portion of the contact region extends towards the axis.

9. The electrical connector of claim 1, wherein:

the contact region extends between the first end region and a free end of the contact region; and the contact region is operative to contact a first conductive region of the plug and deflect towards the first end region when the plug is inserted into the cavity.

10. The electrical connector of claim 9, wherein the free end of the contact region is operative to contact a portion of the first end region when the contact region deflects towards the first end region.

11. The electrical connector of claim 1, wherein the first jack contact is operative to exert an expansion force on a portion of the enclosure.

12. The electrical connector of claim 1, wherein the first jack contact is operative to exert an expansion force on a portion of the enclosure when the plug is inserted into the cavity.

13. The electrical connector of claim 12, further comprising a jack pad, wherein the expansion force maintains an electrical connection between the first jack and the jack pad.

14. The electrical connector of claim 1, further comprising a jack pad, wherein the position of the tab with respect to the position of the jack pad orients a conductive portion of the first jack contact with the jack pad.

15. The electrical connector of claim 1, wherein the contact region comprises only a single contact band extending from the first end region towards the axis.

16. The electrical connector of claim 15, wherein the single contact band extends from the entirety of the first end region between the first edge and the second edge towards the axis.

17. The electrical connector of claim 15, wherein:

the first jack contact further comprises a second end region extending about at least a second portion of the axis;

the single contact band extends between the first end region and the second end region; and a portion of the single contact band extends towards the axis.

* * * * *